US010102810B2

(12) United States Patent
Nakanishi et al.

(10) Patent No.: US 10,102,810 B2
(45) Date of Patent: Oct. 16, 2018

(54) DISPLAY DEVICE AND ELECTRONIC APPARATUS

(71) Applicant: Japan Display Inc., Minato-ku (JP)

(72) Inventors: Takayuki Nakanishi, Minato-ku (JP); Tatsuya Yata, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 289 days.

(21) Appl. No.: 14/982,465

(22) Filed: Dec. 29, 2015

(65) Prior Publication Data

US 2016/0203772 A1 Jul. 14, 2016

(30) Foreign Application Priority Data

Jan. 8, 2015 (JP) ..... 2015-002656

(51) Int. Cl.

| | |
|---|---|
| ***G09G 3/34*** | (2006.01) |
| ***G09G 3/20*** | (2006.01) |
| ***G09G 3/36*** | (2006.01) |
| ***G09G 3/3225*** | (2016.01) |
| *G09G 3/32* | (2016.01) |

(52) U.S. Cl.

CPC ..... *G09G 3/3413* (2013.01); *G09G 3/2003* (2013.01); *G09G 3/3225* (2013.01); *G09G 3/3607* (2013.01); *G09G 3/3648* (2013.01); *G09G 2300/0426* (2013.01); *G09G 2300/0452* (2013.01); *G09G 2320/0233* (2013.01); *G09G 2320/0271* (2013.01); *G09G 2320/0276* (2013.01); *G09G 2320/0633* (2013.01); *G09G 2320/0666* (2013.01); *G09G 2320/0673* (2013.01); *G09G 2340/06* (2013.01); *G09G 2360/16* (2013.01)

(58) Field of Classification Search

CPC ... G09G 3/3413; G09G 3/2003; G09G 3/3225
See application file for complete search history.

(56) References Cited

U.S. PATENT DOCUMENTS

| | | | | |
|---|---|---|---|---|
| 8,810,613 | B2 | 8/2014 | Higashi et al. | |
| 2012/0050345 | A1* | 3/2012 | Higashi ..... | G09G 3/3426 345/690 |
| 2014/0313246 | A1 | 10/2014 | Higashi et al. | |

FOREIGN PATENT DOCUMENTS

| | | |
|---|---|---|
| JP | 2011-154322 | 8/2011 |

* cited by examiner

*Primary Examiner* — Michael Faragalla
*Assistant Examiner* — Chayce Bibbee
(74) *Attorney, Agent, or Firm* — Oblon, McClelland, Maier & Neustadt, L.L.P.

(57) ABSTRACT

A display device includes: an image display panel including a plurality of pixels each including a first sub-pixel, a second sub-pixel, and a third sub-pixel that display a first color to a third color; and a signal processing unit. The signal processing unit stores an expanded color space, acquires an expansion coefficient for expanding a color displayed by the image display panel to a color that can be extended in the expanded color space, obtains output signals of the first sub-pixel to the third sub-pixel based on at least input signals of the first sub-pixel to the third sub-pixel and the expansion coefficient, and outputs the output signals to the first sub-pixel to the third sub-pixel. The expanded color space is a color space that can extend a color the brightness of which is higher than brightness in a standard color space.

8 Claims, 14 Drawing Sheets

DISPLAY DEVICE AND ELECTRONIC APPARATUS

CROSS-REFERENCE TO RELATED APPLICATIONS

This application claims priority from Japanese Application No. 2015-002656, filed on Jan. 8, 2015, the contents of which are incorporated by reference herein in its entirety.

BACKGROUND

1. Technical Field

The present disclosure relates to a display device and an electronic apparatus.

2. Description of the Related Art

A liquid crystal display panel, a self-luminous type display panel that emits light from a self-luminous body such as an organic light-emitting diode (OLED), and the like include a plurality of pixels each including a first sub-pixel that displays red, a second sub-pixel that displays green, and a third sub-pixel that displays blue, for example. A technique has been developed for improving brightness of the pixel by adding a fourth sub-pixel that displays white to the pixel.

Even when colors are displayed based on output signals having the same gradation, the brightness of the displayed colors may be different due to a difference in element characteristics. For example, the brightness of the third sub-pixel that displays blue may be smaller than that of the other sub-pixels. Accordingly, in this case, to keep color balance, the brightness of the first sub-pixel and the second sub-pixel may be limited to correspond to the maximum brightness of the third sub-pixel by providing a light shielding layer or adjusting an output in a circuit.

When the maximum brightness is limited, the brightness may be expanded only up to brightness lower than the brightness that can be actually expressed, so that an image having high brightness cannot possibly be displayed appropriately.

To solve the above problem, the present invention provides an electronic apparatus and a display device that each appropriately display an image having high brightness.

SUMMARY

According to an aspect, A display device including an image display panel including a plurality of pixels each including a first sub-pixel that displays a first color, a second sub-pixel that displays a second color, and a third sub-pixel that displays a third color, and a signal processing unit that generates an output signal from an input value of an input signal, and outputs the output signal to the image display panel. In the third sub-pixel, a third sub-pixel maximum brightness as a displayable upper limit value of brightness of the third color is smaller than one of a first sub-pixel maximum brightness as a displayable upper limit value of brightness of the first color of the first sub-pixel and a second sub-pixel maximum brightness as a displayable upper limit value of brightness of the second color of the second sub-pixel, and is equal to or smaller than the other of the first sub-pixel maximum brightness and the second sub-pixel maximum brightness. The signal processing unit stores an expanded color space extended with the first color, the second color, and the third color in a case in which the output signal for displaying the first color within a range of the first sub-pixel maximum brightness is output to the first sub-pixel, the output signal for displaying the second color within a range of the second sub-pixel maximum brightness is output to the second sub-pixel, and the output signal for displaying the third color within a range of the third sub-pixel maximum brightness is output to the third sub-pixel. The signal processing unit acquires an expansion coefficient for expanding a color displayed by the image display panel to a color that is capable of being extended in the expanded color space. The signal processing unit obtains an output signal of the first sub-pixel based on at least an input signal of the first sub-pixel and the expansion coefficient and outputs the output signal to the first sub-pixel. The signal processing unit obtains an output signal of the second sub-pixel based on at least an input signal of the second sub-pixel and the expansion coefficient and outputs the output signal to the second sub-pixel. The signal processing unit obtains an output signal of the third sub-pixel based on at least an input signal of the third sub-pixel and the expansion coefficient and outputs the output signal to the third sub-pixel. The expanded color space is a color space in which the upper limit value of the brightness in a case of displaying at least one of the first color and the second color is larger than the third sub-pixel maximum brightness, and being capable of extending a color the brightness of which is higher than brightness in a standard color space. The standard color space is extended with the first color, the second color, and the third color in a case of outputting the output signal for displaying a color in a case in which an upper limit value of displayable brightness is limited to the third sub-pixel maximum brightness to the first sub-pixel and the second sub-pixel, and outputting the output signal for displaying the color of the third sub-pixel maximum brightness to the third sub-pixel.

DETAILED DESCRIPTION

Figure 1:
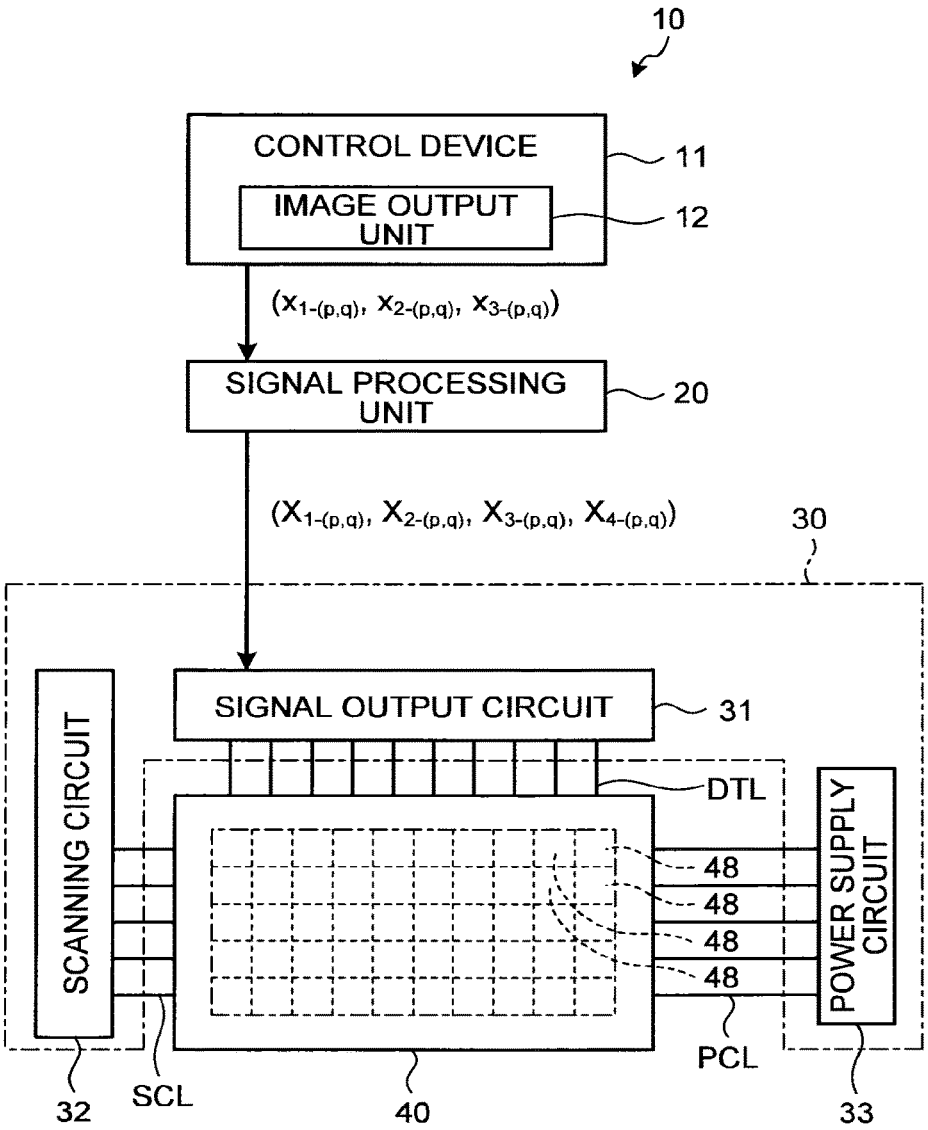
FIG. 1 is a block diagram illustrating an example of the configuration of a display device according to a first embodiment.

The following describes embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

First Embodiment

Configuration of Display Device

FIG. 1 is a block diagram illustrating an example of the configuration of a display device according to a first embodiment of the present invention. As illustrated in FIG. 1, a display device 10 according to the first embodiment includes a signal processing unit 20, an image display panel driving unit 30, and an image display panel 40. The signal processing unit 20 receives an input signal (RGB data) input from an image output unit 12 of a control device 11, and transmits, to each unit of the display device 10, a signal generated by performing predetermined data conversion processing on the input signal. The image display panel driving unit 30 controls driving of the image display panel 40 based on the signal from the signal processing unit 20. The image display panel 40 is a self-luminous type image display panel that lights a self-luminous body of a pixel to display an image based on a signal from the image display panel driving unit 30.

Configuration of Image Display Panel

Figure 2:
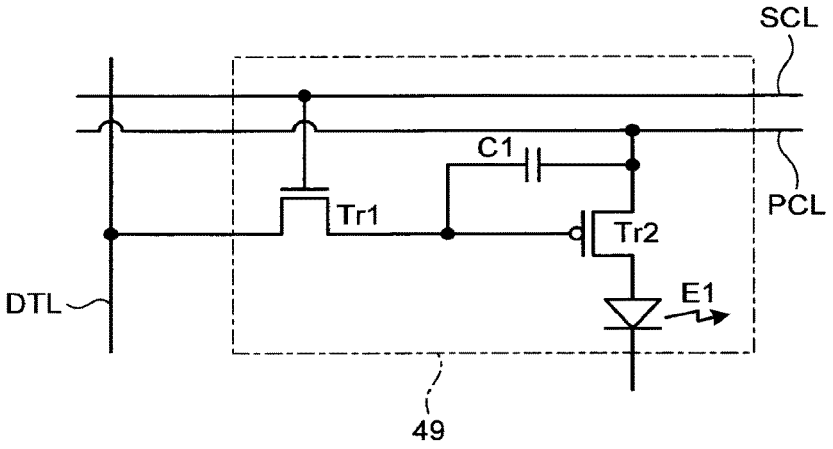
FIG. 2 is a diagram illustrating a lighting drive circuit of a sub-pixel included in a pixel of an image display panel according to the first embodiment.
Figure 3:
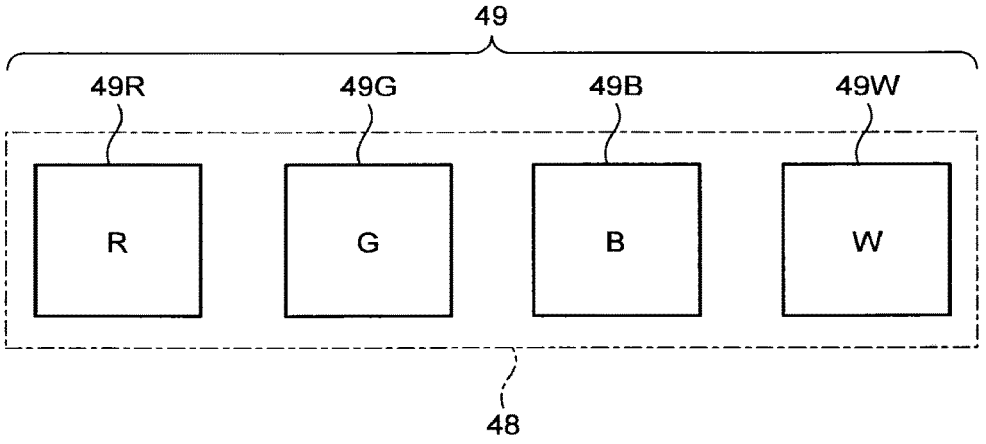
FIG. 3 is a diagram illustrating an array of sub-pixels of the image display panel according to the first embodiment.
Figure 4:
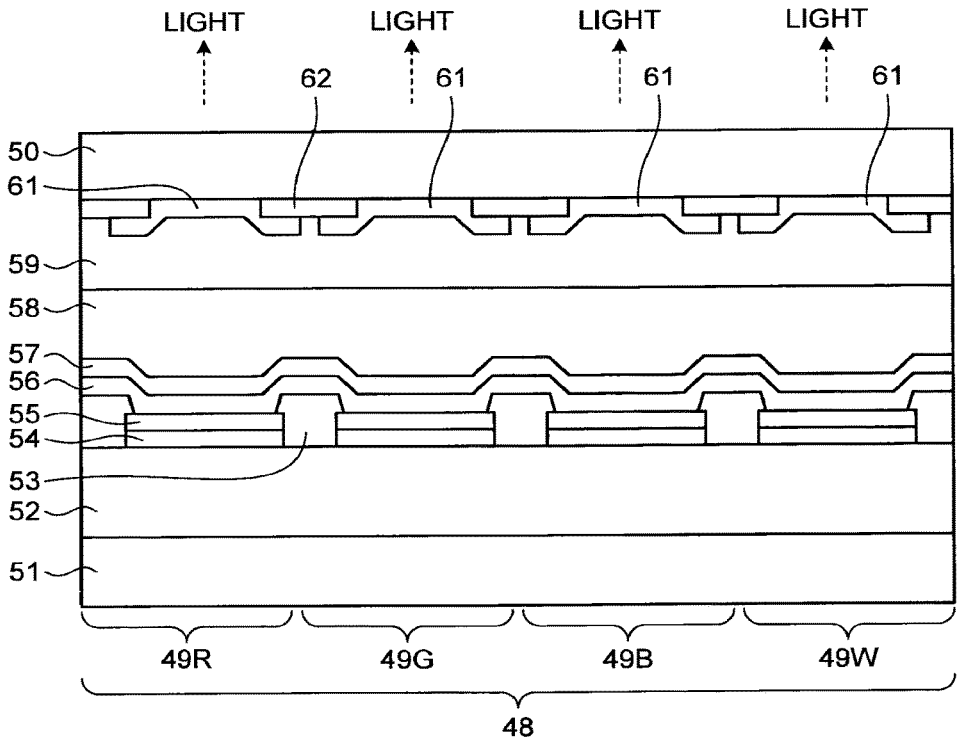
FIG. 4 is a diagram illustrating a cross-sectional structure of the image display panel according to the first embodiment.

First, the following describes the configuration of the image display panel 40. FIG. 2 is a diagram illustrating a lighting drive circuit of a sub-pixel included in a pixel of the image display panel according to the first embodiment. FIG. 3 is a diagram illustrating an array of sub-pixels of the image display panel according to the first embodiment. FIG. 4 is a diagram illustrating a cross-sectional structure of the image display panel according to the first embodiment. As illustrated in FIG. 1, the image display panel 40 includes $P_0 \times Q_0$ ($P_0$ in a row direction, and $Q_0$ in a column direction) pixels 48 arrayed therein in a two-dimensional matrix (rows and columns).

Each pixel 48 includes a plurality of sub-pixels 49, and lighting drive circuits of the sub-pixels 49 illustrated in FIG. 2 are arrayed in a two-dimensional matrix (rows and columns). As illustrated in FIG. 2, the lighting drive circuit includes a control transistor Tr1, a driving transistor Tr2, and a charge holding capacitor C1. The gate of the control transistor Tr1 is coupled to a scanning line SCL, the source thereof is coupled to a signal line DTL, and the drain thereof is coupled to the gate of the driving transistor Tr2. One end of the charge holding capacitor C1 is coupled to the gate of the driving transistor Tr2, and the other end thereof is coupled to the source of the driving transistor Tr2. The source of the driving transistor Tr2 is coupled to a power supply line PCL, and the drain of the driving transistor Tr2 is coupled to the anode of an organic light-emitting diode E1 serving as the self-luminous body. The cathode of the organic light-emitting diode E1 is coupled to a reference potential (such as a ground), for example. FIG. 2 illustrates an example in which the control transistor Tr1 is an n-channel transistor, and the driving transistor Tr2 is a p-channel transistor. However, polarities of the respective transistors are not limited thereto. The polarities of the control transistor Tr1 and the driving transistor Tr2 may be determined as needed.

As illustrated in FIG. 3, the pixel 48 includes a first sub-pixel 49R, a second sub-pixel 49G, a third sub-pixel 49B, and a fourth sub-pixel 49W. The first sub-pixel 49R displays a primary color of red as a first color. The second sub-pixel 49G displays a primary color of green as a second color. The third sub-pixel 49B displays a primary color of blue as a third color. The fourth sub-pixel 49W displays white as a fourth color different from the first color, the second color, and the third color. However, the first color, the second color, the third color, and the fourth color are not limited to red, green, blue, and white, respectively, and arbitrary colors such as complementary colors can be selected. Hereinafter, when it is not necessary to distinguish the first sub-pixel 49R, the second sub-pixel 49G, the third sub-pixel 49B, and the fourth sub-pixel 49W from each other, they are collectively referred to as the sub-pixels 49.

Element characteristics such as a color to be displayed and individual variation of the lighting drive circuit are different among the first sub-pixel 49R, the second sub-pixel 49G, and the third sub-pixel 49B, so that a displayable upper limit value of the brightness of the color displayed is different thereamong. The displayable upper limit value of the brightness of red (first color) of the first sub-pixel 49R is referred to as a first sub-pixel maximum brightness, the displayable upper limit value of the brightness of green (second color) of the second sub-pixel 49G is referred to as a second sub-pixel maximum brightness, and the displayable upper limit value of the brightness of blue (third color) of the third sub-pixel 49B is referred to as a third sub-pixel maximum brightness. That is, the first sub-pixel maximum brightness, the second sub-pixel maximum brightness, and the third sub-pixel maximum brightness are the brightnesses of colors displayed by the first sub-pixel 49R, the second sub-pixel 49G, and the third sub-pixel 49B when an output signal having a maximum gradation value is output to each sub-pixel 49.

In the first embodiment, descending order of the values of the brightness is as follows: the second sub-pixel maximum brightness, the first sub-pixel maximum brightness, and the third sub-pixel maximum brightness. That is, the brightness of the color that can be displayed by the second sub-pixel 49G is the largest, the brightness of the color that can be displayed by the first sub-pixel 49R is the next largest, and the brightness of the color that can be displayed by the third sub-pixel 49B is the smallest. However, the first color, the second color, and the third color can be arbitrarily set, so that a magnitude relation among the first sub-pixel maximum brightness, the second sub-pixel maximum brightness, and the third sub-pixel maximum brightness is not limited thereto. When the third sub-pixel maximum brightness is smaller than one of the first sub-pixel maximum brightness and the second sub-pixel maximum brightness and equal to or smaller than the other one thereof, the sub-pixel 49 can optionally set a color to be displayed, a configuration, and the like for each sub-pixel.

When the displayable upper limit value of the brightness of white (fourth color) of the fourth sub-pixel 49W is defined as a fourth sub-pixel maximum brightness, the fourth sub-pixel maximum brightness is larger than the first sub-pixel maximum brightness, the second sub-pixel maximum brightness, and the third sub-pixel maximum brightness. However, the embodiment is not limited thereto. The color displayed by the fourth sub-pixel 49W is optional, not limited to white. For example, the fourth sub-pixel 49W may display yellow as the fourth color.

As illustrated in FIG. 4, the image display panel 40 includes a substrate 51, insulating layers 52 and 53, a reflective layer 54, a lower electrode 55, a self-luminous layer 56, an upper electrode 57, an insulating layer 58, an insulating layer 59, a color filter 61 serving as a color conversion layer, a black matrix 62 serving as a light shielding layer, and a substrate 50. The substrate 51 is, for example, a semiconductor substrate made of silicon and the like, a glass substrate, and a resin substrate, and forms or holds the lighting drive circuit described above and the like. The insulating layer 52 is a protective film that protects the lighting drive circuit and the like, and made of a silicon oxide, a silicon nitride, and the like. The lower electrode 55 is provided to each of the first sub-pixel 49R, the second sub-pixel 49G, the third sub-pixel 49B, and the fourth sub-pixel 49W, and is an electric conductor serving as the anode (positive pole) of the organic light-emitting diode E1 described above. The lower electrode 55 is a translucent electrode made of a translucent conductive material (translucent conductive oxide) such as an indium tin oxide (ITO). The insulating layer 53 is called a bank, which is an insulating layer for separating the first sub-pixel 49R, the second sub-pixel 49G, the third sub-pixel 49B, and the fourth sub-pixel 49W from each other. The reflective layer 54 is made of a material, such as silver, aluminum, and gold, having metallic luster that reflects light from the self-luminous layer 56. The self-luminous layer 56 includes an organic material, and includes a hole injection layer, a hole transport layer, a light emitting layer, an electron transport layer, and an electron injection layer that are not illustrated.

Hole Transport Layer

As a layer that generates a positive hole, for example, preferably used is a layer including an aromatic amine compound and a substance that exhibits an electron accepting property to the compound. The aromatic amine compound is a substance having an arylamine skeleton. Among aromatic amine compounds, especially preferred is a compound in which the skeleton includes triphenylamine and the molecular weight of which is 400 or more. Among the aromatic amine compounds in which the skeleton includes triphenylamine, especially preferred is a compound the skeleton of which includes a condensed aromatic ring such as a naphthyl group. Use of the aromatic amine compound that includes triphenylamine and the condensed aromatic ring as the skeleton improves heat resistance of a light-emitting element. Specific examples of the aromatic amine compound include, but are not limited to, 4,4'-bis[N-(1-naphthyl)-N-phenylamino]biphenyl (abbreviated as α-NPD), 4,4'-bis[N-(3-methylphenyl)-N-phenylamino]biphenyl (abbreviated as TPD), 4,4',4"-tris(N,N-diphenylamino)triphenylamine (abbreviated as TDATA), 4,4',4"-tris[N-(3-methylphenyl)-N-phenylamino]triphenylamine (abbreviated as MTDATA), 4,4'-bis[N-{4-(N,N-di-m-tolylamino)phenyl}-N-phenylamino]biphenyl (abbreviated as DNTPD), 1,3,5-tris[N,N-di(m-tolyl)amino]benzene (abbreviated as m-MTDAB), 4,4',4"-tris(N-carbazolyl)triphenylamine (abbreviated as TCTA), 2,3-bis (4-diphenylaminophenyl)quinoxaline (abbreviated as TPAQn), 2,2',3,3'-tetrakis(4-diphenylaminophenyl)-6,6'-bisquinoxaline (abbreviated as D-TriPhAQn), 2,3-bis{4-[N-(1-naphthyl)-N-phenylamino]phenyl}-dibenzo[f,h]quinoxaline (abbreviated as NPADiBzQn), etc. The substance that exhibits the electron accepting property to the aromatic amine compound is not specifically limited. Examples of this substance may include, but are not limited to, a molybdenum oxide, a vanadium oxide, 7,7,8,8-tetracyanoquinodimethane (abbreviated as TCNQ), 2,3,5,6-tetrafluoro-7,7,8,8-tetracyanoquinodimethane (abbreviated as F4-TCNQ), etc.

Electron Injection Layer and Electron Transport Layer

An electron transport substance is not specifically limited. Examples of the electron transport substance may include, but are not limited to, a metal complex such as tris(8-quinolinolato)aluminum (abbreviated as Alq3), tris(4-methyl-8-quinolinolato)aluminum (abbreviated as Almq3), bis(10-hydroxybenzo[h]-quinolinolato)beryllium (abbreviated as BeBq2), bis(2-methyl-8-quinolinolato)-4-phenylphenolate-aluminum (abbreviated as BAlq), bis[2-(2-hydroxyphenyl)benzoxazolato]zinc (abbreviated as Zn(BOX)2), and bis[2-(2-hydroxyphenyl)benzothiazolato]zinc (abbreviated as Zn(BTZ)2). The examples of the electron transport substance may also include 2-(4-biphenylyl)-5-(4-tert-butylphenyl)-1,3,4-oxadiazole (abbreviated as PBD), 1,3-bis[5-(p-tert-butylphenyl)-1,3,4-oxadiazole-2-yl]benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), bathocuproin (abbreviated as BCP), etc. A substance that exhibits an electron donating property to the electron transport substance is not specifically limited. Examples of the substance may include, but are not limited to, an alkali metal such as lithium and cesium, an alkaline-earth metal such as magnesium and calcium, a rare earth metal such as erbium and ytterbium, etc. A substance selected from among alkali metal oxides and alkaline-earth metal oxides such as a lithium oxide (Li2O), a calcium oxide (CaO), a sodium oxide (Na2O), a potassium oxide (K2O), and a magnesium oxide (MgO) may be used as the substance that exhibits the electron donating property to the electron transport substance.

Light Emitting Layer

For example, to obtain red-based light emission, a substance exhibiting light emission that has the peak of emission spectrum in a range from 600 nm to 680 nm may be used such as 4-dicyanomethylene-2-isopropyl-6-[2-(1,1,7,7-tetramethyljulolidine-9-yl)ethenyl]-4H-pyrane (abbreviated as DCJTI), 4-dicyanomethylene-2-methyl-6-[2-(1,1,7,7-tetramethyljulolidine-9-yl)ethenyl]-4H-pyrane (abbreviated as DCJT), 4-dicyanomethylene-2-tert-butyl-6-[2-(1,1,7,7-tetramethyljulolidine-9-yl)ethenyl]-4H-pyrane (abbreviated as DCJTB), periflanthene, and 2,5-dicyano-1,4-bis[2-(10-methoxy-1,1,7,7-tetramethyljulolidine-9-yl)ethenyl]benzene. To obtain green-based light emission, a substance exhibiting light emission that has the peak of emission spectrum in a range from 500 nm to 550 nm may be used such as N,N'-dimethylquinacridone (abbreviated as DMQd), coumarin 6, coumarin 545T, and tris(8-quinolinolato)aluminum (abbreviated as Alq3). To obtain blue-based light emission, a substance exhibiting light emission that has the peak of emission spectrum in a range from 420 nm to 500 nm may be used such as 9,10-bis(2-naphthyl)-tert-butylanthracene (abbreviated as t-BuDNA), 9,9'-bianthryl, 9,10-diphenylanthracene (abbreviated as DPA), 9,10-bis(2-naphthyl)anthracene (abbreviated as DNA), bis(2-methyl-8-quinolinolato)-4-phenylphenolate-gallium (abbreviated as BGaq), and bis(2-methyl-8-quinolinolato)-4-phenylphenolate-aluminum (abbreviated as BAlq). As described above, in addition to the substance that emits fluorescent light, a substance that emits phosphorescent light may be used as the light-emitting substance such as bis[2-(3,5-bis(trifluoromethyl)phenyl)pyridinato-N,C2']iridium (III) picolinate (abbreviated as Ir(CF3ppy)2(pic)), bis[2-(4,6-difluorophenyl)pyridinato-N,C2']iridium (III) acetylacetonate (abbreviated as FIr(acac)), bis[2-(4,6-difluorophenyl)pyridinato-N,C2']iridium (III) picolinate (FIr(pic)), and tris(2-phenylpyridinato-N,C2')iridium (abbreviated as Ir(ppy)3).

The upper electrode 57 is a translucent electrode made of a translucent conductive material (translucent conductive oxide) such as an indium tin oxide (ITO). In this embodiment, the ITO is exemplified as the translucent conductive material. However, the translucent conductive material is not limited thereto. As the translucent conductive material, a conductive material having different composition such as an indium zinc oxide (IZO) may be used. The upper electrode 57 is the cathode (negative pole) of the organic light-emitting diode E1. The insulating layer 58 is a sealing layer that seals the upper electrode, and may be made of a silicon oxide, a silicon nitride, and the like. The insulating layer 59 is a planarization layer that prevents a level difference due to the bank, and may be made of a silicon oxide, a silicon nitride, and the like. The substrate 50 is a translucent substrate that protects the entire image display panel 40, and may be a glass substrate, for example. FIG. 4 illustrates an example in which the lower electrode 55 is the anode (positive pole) and the upper electrode 57 is the cathode (negative pole). However, the embodiment is not limited thereto. The lower electrode 55 may be the cathode and the upper electrode 57 may be the anode. In this case, the polarity of the driving transistor Tr2 that is electrically coupled to the lower electrode 55 can be appropriately changed, and a stacking order of the carrier injection layer (the hole injection layer and the electron injection layer), the carrier transport layer (the hole transport layer and the electron transport layer), and the light emitting layer can be appropriately changed.

The image display panel 40 is a color display panel in which the color filter 61 for transmitting light of a color corresponding to the color of the sub-pixel 49 among components of light emitted from the self-luminous layer 56 is arranged between the sub-pixel 49 and an image observer. The image display panel 40 can emit light of colors corresponding to red, green, blue, and white. The color filter 61 is not necessarily arranged between the fourth sub-pixel 49W corresponding to white and the image observer. In the image display panel 40, the components of light emitted from the self-luminous layer 56 can be of colors of the first sub-pixel 49R, the second sub-pixel 49G, the third sub-pixel 49B, and the fourth sub-pixel 49W without using the color conversion layer such as the color filter 61. For example, in the image display panel 40, a transparent resin layer may be provided to the fourth sub-pixel 49W in place of the color filter 61 for color adjustment. In this way, by providing the transparent resin layer, the image display panel 40 can prevent a large level difference in the fourth sub-pixel 49W.

Figure 5:
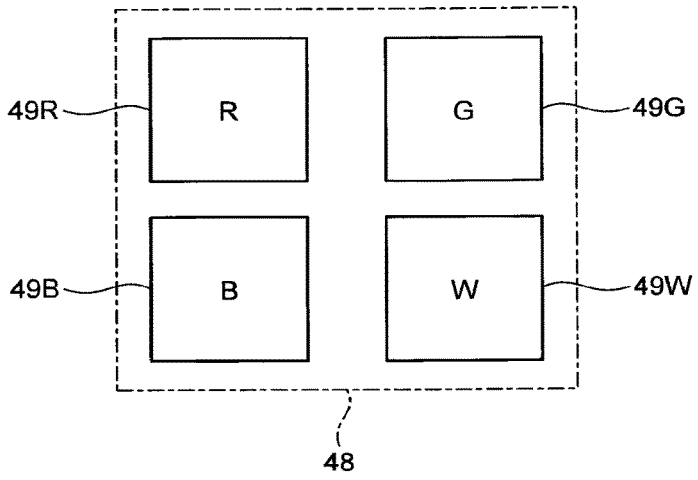
FIG. 5 is a diagram illustrating another array of sub-pixels of the image display panel according to the first embodiment.

FIG. 5 is a diagram illustrating another array of sub-pixels of the image display panel according to the first embodiment. In the image display panel 40, the pixels 48 are arranged in a matrix, the pixels 48 each including an array of two rows and two columns of sub-pixels 49 including the first sub-pixel 49R, the second sub-pixel 49G, the third sub-pixel 49B, and the fourth sub-pixel 49W. In this way, in the image display panel 40, the array of the sub-pixels 49 in the pixel 48 may be arbitrarily set.

Configuration of Signal Processing Unit

The following describes the signal processing unit 20. The signal processing unit 20 processes the input signal input from the control device 11 to generate an output signal. The signal processing unit 20 converts the input value of the input signal displayed by combining the colors of red (first color), green (second color), and blue (third color) into an extended value (output signal) of an expanded color space (in the first embodiment, an HSV (Hue-Saturation-Value, Value is also called Brightness) color space) extended with red (first color), green (second color), blue (third color), and white (fourth color) to generate an output signal. The signal processing unit 20 outputs the generated output signal to the image display panel driving unit 30. The expanded color space will be described later. In the first embodiment, the expanded color space is the HSV color space. However, the embodiment is not limited thereto. The expanded color space may be an XYZ color space, a YUV space, or another coordinate system.

Figure 6:
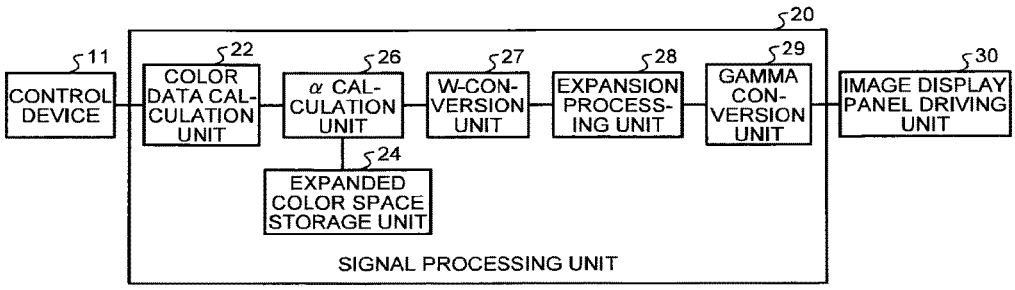
FIG. 6 is a schematic block diagram illustrating the configuration of a signal processing unit according to the first embodiment.

FIG. 6 is a schematic block diagram illustrating the configuration of the signal processing unit according to the first embodiment. As illustrated in FIG. 6, the signal processing unit 20 includes a color data calculation unit 22, an expanded color space storage unit 24, an α calculation unit 26, a W-conversion unit 27, an expansion processing unit 28, and a gamma conversion unit 29. The signal processing unit 20 is electrically coupled to the image display panel driving unit 30.

The color data calculation unit 22 receives the input signal input from the control device 11. The input signal has gradation signal values of red, green, and blue, and displays a predetermined color by combining the gradation signal values. The color data calculation unit 22 calculates, from the input value of the input signal, the hue and saturation of the color to be displayed in accordance with the input signal.

The color data calculation unit 22 outputs, to the α calculation unit 26, the input signal and the calculated values of the hue and the saturation.

The expanded color space storage unit 24 stores the expanded color space. Although details will be described later, the expanded color space is a color space that represents a range of the color that can be displayed by the image display panel 40, and determined based on the element characteristic of each sub-pixel 49. For example, to the expanded color space storage unit 24, written is data of the expanded color space calculated as experiment data, or the data of the expanded color space determined based on the element characteristic of each sub-pixel 49 inspected when a product is shipped and the like.

The α calculation unit 26 calculates an expansion coefficient for expanding the input signal based on the input signal, the hue and the saturation of the color to be displayed in accordance with the input signal calculated by the color data calculation unit 22, and the expanded color space. More specifically, the α calculation unit 26 receives the input signal, and the hue and the saturation of the color to be displayed in accordance with the input signal input from the color data calculation unit 22. The α calculation unit 26 stores a set expansion coefficient α0 the value of which is set in advance for expanding the input signal. The α calculation unit 26 multiplies the signal value of the input signal by the set expansion coefficient α0 to calculate a first comparison signal value. The set expansion coefficient α0 may be set through an operation by a user and the like, for example.

The α calculation unit 26 reads out the data of the expanded color space from the expanded color space storage unit 24. The α calculation unit 26 compares the brightness of the first comparison signal value with the upper limit value of the brightness in the expanded color space to calculate an expansion coefficient α for expanding the input signal. More specifically, when the brightness of the color corresponding to the first comparison signal value does not exceed the upper limit value of the brightness in the expanded color space, the α calculation unit 26 sets the set expansion coefficient α0 to be the expansion coefficient α. When the brightness of the first comparison signal value exceeds the upper limit value of the brightness of the expanded color space, the α calculation unit 26 calculates the expansion coefficient α so that the brightness of the color corresponding to a second comparison signal value calculated by multiplying the signal value of the input signal by the expansion coefficient α does not exceed the upper limit value of the brightness in the expanded color space. The α calculation unit 26 outputs the calculated value of the expansion coefficient α and the input signal to the W-conversion unit 27.

The α calculation unit 26 does not necessarily calculate the expansion coefficient α using the set expansion coefficient α0 as described above so long as the α calculation unit 26 calculates the expansion coefficient for expanding the input signal based on the input signal, the hue and the saturation of the color to be displayed in accordance with the input signal, and the expanded color space. For example, the α calculation unit 26 may calculate the expansion coefficient α so that the brightness of the color corresponding to the signal value calculated by multiplying the signal value of the input signal by the expansion coefficient α does not exceed the upper limit value of the brightness in the expanded color space.

The W-conversion unit 27 receives the expansion coefficient α and the input signal. The W-conversion unit 27 converts the input value of the input signal displayed by combining the colors of red, green, and blue into a signal value of red, green, blue, and white. The W-conversion unit 27 calculates an output signal value for displaying white to be output to the fourth sub-pixel 49W based on the input signal having the gradation signal values of red, green, and blue, and the expansion coefficient α. The W-conversion unit 27 outputs the input signal, the expansion coefficient α, and the output signal value of the fourth sub-pixel 49W to the expansion processing unit 28. Details about processing of calculating the output signal value of the fourth sub-pixel 49W performed by the W-conversion unit 27 will be described later.

The expansion processing unit 28 receives the input signal, the expansion coefficient α, and the output signal value of the fourth sub-pixel 49W. The expansion processing unit 28 expands input signals of the first sub-pixel 49R, the second sub-pixel 49G, and the third sub-pixel 49B to generate output signals of the first sub-pixel 49R, the second sub-pixel 49G, and the third sub-pixel 49B based on the input signal, the expansion coefficient α, and the output signal value of the fourth sub-pixel 49W. The expansion processing unit 28 outputs the output signal value of each sub-pixel 49 to the gamma conversion unit 29. Details about processing of generating the output signal performed by the expansion processing unit 28 will be described later.

The gamma conversion unit 29 receives an output signal value input from each pixel 49. The gamma conversion unit 29 performs gamma conversion on the output signal value of each pixel 49 to generate an image output signal having predetermined electric potential for displaying the color corresponding to the output signal value, and outputs the image output signal to the image display panel driving unit 30.

Configuration of Image Display Panel Driving Unit

The image display panel driving unit 30 is a control device for the image display panel 40, and includes a signal output circuit 31, a scanning circuit 32, and a power supply circuit 33. The signal output circuit 31 is electrically coupled to the image display panel 40 via the signal line DTL. The signal output circuit 31 holds an input image output signal, and successively outputs an image output signal to each sub-pixel 49 of the image display panel 40. The scanning circuit 32 is electrically coupled to the image display panel 40 via the scanning line SCL. The scanning circuit 32 selects the sub-pixel 49 in the image display panel, and controls ON/OFF of a switching element (for example, a thin film transistor (TFT)) for controlling an operation (light emitting intensity) of the sub-pixel 49. The power supply circuit 33 supplies electric power to the organic light-emitting diode E1 of each sub-pixel 49 via the power supply line PCL.

Standard Color Space

The following describes a standard color space that is a color space that can be extended by the image display panel according to a comparative example. As described above, the element characteristics are different among the first sub-pixel 49R, the second sub-pixel 49G, and the third sub-pixel 49B, so that the first sub-pixel maximum brightness, the second sub-pixel maximum brightness, and the third sub-pixel maximum brightness are different from each other. The third sub-pixel maximum brightness is smaller than the first sub-pixel maximum brightness and the second sub-pixel maximum brightness. That is, even when the input signal value having the same maximum gradation is input, the brightness of blue displayed by the third sub-pixel 49B is smaller than the brightness of red and green displayed by the first sub-pixel 49R and the second sub-pixel 49G, respectively. Accordingly, for example, in order to display white, when the input signal values having the same maximum gradation are input to the respective first sub-pixel 49R, the second sub-pixel 49G, and the third sub-pixel 49B, the brightness is different among the respective colors, so that a color shifted from white may be displayed in some cases. For this, similarly to the image display panel according to the comparative example, to keep color balance, the image display panel typically limits the maximum brightness (the upper limit value of displayable brightness) of the first sub-pixel 49R and the second sub-pixel 49G in accordance with the maximum brightness of the third sub-pixel 49B. Accordingly, the maximum brightnesses of the first sub-pixel 49R and the second sub-pixel 49G in the standard color space are limited in accordance with the third sub-pixel maximum brightness of the third sub-pixel 49B, and becomes the same as the third sub-pixel maximum brightness. Thus, the displayable maximum brightness of the color displayed by combining the colors of the first sub-pixel 49R, the second sub-pixel 49G, and the third sub-pixel 49B is the same as the third sub-pixel maximum brightness.

The fourth sub-pixel 49W can widen the dynamic range of the brightness by adding a white component as compared with a case of displaying the color only with the first sub-pixel 49R, the second sub-pixel 49G, and the third sub-pixel 49B. In this way, a color space expanded by adding the fourth sub-pixel 49W in which the displayable maximum brightnesses of the first sub-pixel 49R and the second sub-pixel 49G are limited in accordance with the third sub-pixel maximum brightness is referred to as the standard color space hereinafter. In other words, the standard color space is a color space that can be extended with the first color (red), the second color (green), the third color (blue), and the fourth color (white) in a case in which the output signal for displaying the color of which the maximum brightness is limited up to the third sub-pixel maximum brightness is output to the first sub-pixel 49R and the second sub-pixel 49G, the output signal for displaying the color of the third sub-pixel maximum brightness is output to the third sub-pixel 49B, and the output signal for displaying the color of the fourth sub-pixel maximum brightness is output to the fourth sub-pixel 49W. The image display panel according to the comparative example expands the input signal to display the color in a range of the standard color space.

Figure 7:
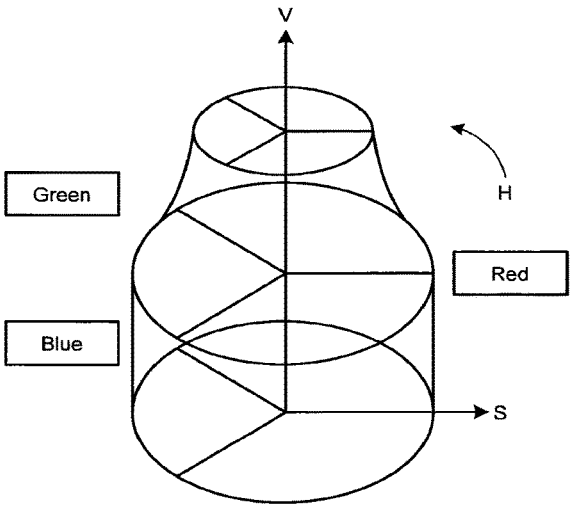
FIG. 7 is a conceptual diagram of a standard color space.
Figure 8:
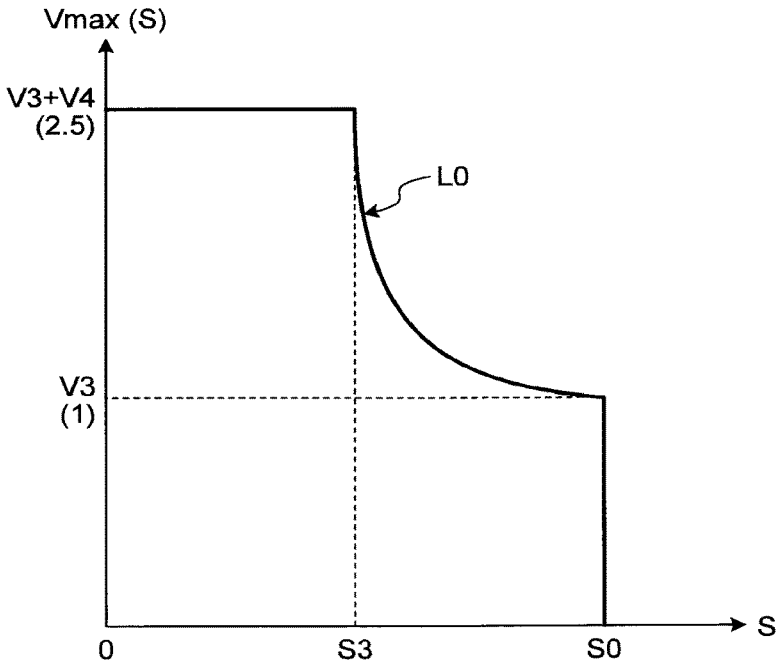
FIG. 8 is a conceptual diagram of a relation between saturation and brightness in the standard color space.

FIG. 7 is a conceptual diagram of the standard color space. FIG. 8 is a conceptual diagram illustrating a relation between the saturation and the brightness in the standard color space. In the first embodiment, the standard color space is the HSV color space. A horizontal axis illustrated in FIG. 7 and FIG. 8 indicates the saturation (S), a vertical axis indicates the brightness (V), and a circumferential axis along a circumferential direction centered around the vertical axis indicates the hue (H). FIG. 8 is a cross-sectional view of the HSV color space in FIG. 7 cut along a cross section orthogonal to a tangential direction of the circumferential axis. Accordingly, FIG. 8 illustrates a relation between the saturation and the brightness in an arbitrary hue in the standard color space. The relation between the saturation and the brightness in the standard color space remains the same irrespective of the hue.

As illustrated in FIGS. 7 and 8, the standard color space has a shape obtained by placing a substantially trapezoidal space on the cylindrical HSV color space as a color space that can be extended with the first sub-pixel 49R and the second sub-pixel 49G the maximum brightness of which is limited and the third sub-pixel 49B, the trapezoidal space being extendable with the fourth sub-pixel 49W in which the maximum value of the brightness V decreases as the saturation S increases. The third sub-pixel maximum brightness is defined as V3, and the fourth sub-pixel maximum brightness is defined as V4. More specifically, the standard color space is obtained by adding a substantially trapezoidal color space in which the maximum brightness is the fourth sub-pixel maximum brightness V4 to the cylindrical HSV color space in which the maximum brightness is the third sub-pixel maximum brightness V3 in a range of the saturation from 0 to the maximum value S0. The third sub-pixel maximum brightness V3 in the standard color space is 1, which corresponds to the maximum value of the gradation of the input signal of the third sub-pixel, and the fourth sub-pixel maximum brightness V4 is 1.5, for example. The image display panel according to the comparative example expands the input signal to widen the color space that can be extended from the cylindrical HSV color space that is part of the standard color space to the entire standard color space, and displays the color.

The maximum value of the brightness that can be extended in the standard color space is represented by a line segment L0 indicating the upper limit value of the brightness for each saturation in the expanded color space. As represented by the line segment L0, the maximum value of the brightness that can be extended in the standard color space is brightness V3+V4 when the saturation is in a range from 0 to S3. The maximum value of the brightness that can be extended in the standard color space decreases from the saturation S3 toward the saturation S0. Saturation S0 is the maximum value of the saturation. The maximum value of the brightness that can be extended in the standard color space becomes the value of the third sub-pixel maximum brightness V3 at the saturation S0.

In this way, the image display panel according to the comparative example may display, when the input signal is expanded, the color in a range of the standard color space as a color space in which the maximum brightness of the first sub-pixel 49R and the second sub-pixel 49G is limited.

Expanded Color Space

Figure 9:
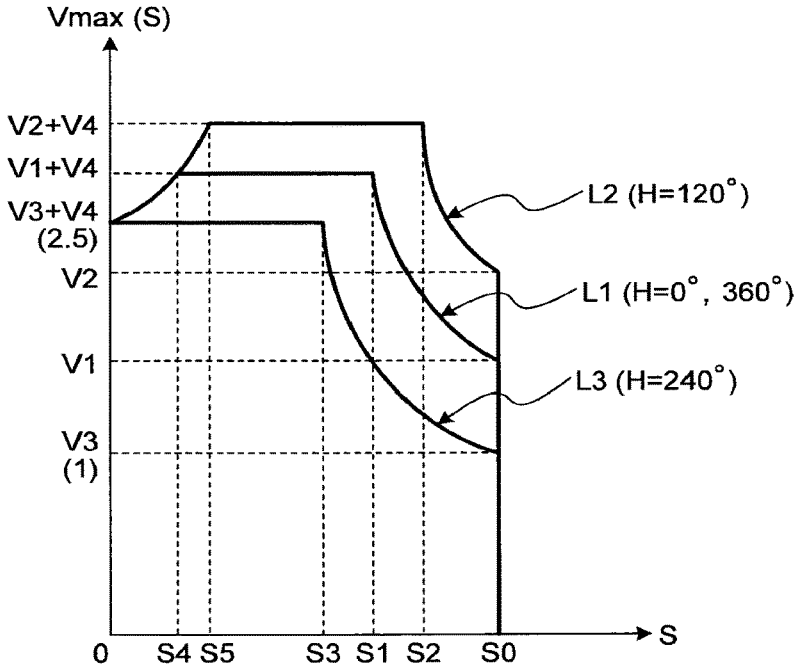
FIG. 9 is a conceptual diagram illustrating a relation between saturation and brightness in an expanded color space with hues of a first color, a second color, and a third color.
Figure 10:
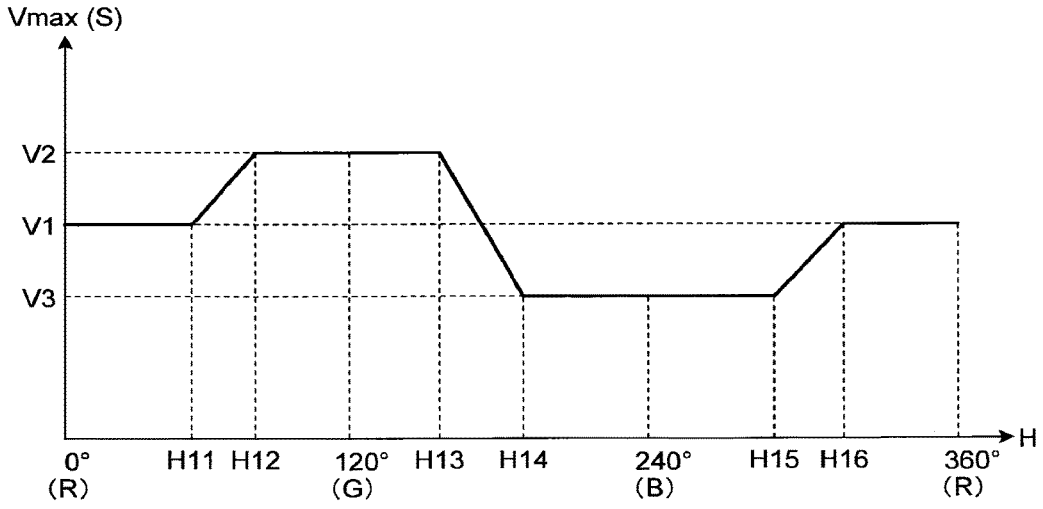
FIG. 10 is a conceptual diagram illustrating a relation between the hue and the brightness in the expanded color space at a maximum saturation.

On the other hand, the expanded color space storage unit 24 according to the first embodiment stores the expanded color space as a color space that can extend the color the brightness of which is higher than that in the standard color space, and the image display panel 40 expands the input signal to display the color in a range of the expanded color space. The expanded color space is a color space in which the maximum brightnesses of the first sub-pixel 49R and the second sub-pixel 49G are not limited. FIG. 9 is a conceptual diagram illustrating a relation between the saturation and the brightness in the expanded color space with the hues of the first color, the second color, and the third color. FIG. 10 is a conceptual diagram illustrating a relation between the hue and the brightness in the expanded color space at a maximum saturation. The hue H is represented in a range from 0° to 360° as illustrated in FIG. 10. From 0° toward 360°, the hue H changes from red to yellow, green, cyan, blue, magenta, and back to red. In the first embodiment, a region including angles 0° and 360° is red, a region including the angle 120° is green, and a region including the angle 240° is blue.

A line segment L1 in FIG. 9 indicates the maximum brightness corresponding to the saturation in a case of displaying the color of the hue of the first color (red) without limiting the maximum brightness with the first sub-pixel 49R and the fourth sub-pixel 49W. That is, the line segment L1 indicates the upper limit value of the color space extended with the hue of the first color (red) in a case in which the output signal for displaying the color of the first sub-pixel maximum brightness is output to the first sub-pixel 49R, and the output signal for displaying the color of the fourth sub-pixel maximum brightness is output to the fourth sub-pixel 49W by expanding the input signal. The hue represented by the line segment L1 is red, so that the hue H is 0° and 360°.

A line segment L2 in FIG. 9 indicates the maximum brightness corresponding to the saturation in a case of displaying the color of the hue of the second color (green) without limiting the maximum brightness with the second sub-pixel 49G and the fourth sub-pixel 49W. That is, the line segment L2 indicates the upper limit value of the color space extended with the hue of the second color (green) in a case in which the output signal for displaying the color of the second sub-pixel maximum brightness is output to the second sub-pixel 49G, and the output signal for displaying the color of the fourth sub-pixel maximum brightness is output to the fourth sub-pixel 49W by expanding the input signal. The hue represented by the line segment L2 is green, so that the hue H is 120°.

A line segment L3 in FIG. 9 indicates the maximum brightness corresponding to the saturation in a case of displaying the color of the hue of the third color (blue) without limiting the maximum brightness with the third sub-pixel 49B and the fourth sub-pixel 49W. That is, the line segment L3 indicates the upper limit value of the color space extended with the hue of the third color (blue) in a case in which the output signal for displaying the color of the third sub-pixel maximum brightness is output to the third sub-pixel 49B, and the output signal for displaying the color of the fourth sub-pixel maximum brightness is output to the fourth sub-pixel 49W by expanding the input signal. The hue represented by the line segment L3 is blue, so that the hue H is 240°. The line segment L3 corresponds to the third sub-pixel maximum brightness, so that the line segment L3 is the same as the line segment L0 in the standard color space.

As indicated by the line segment L1, in a case in which the brightness is not limited, the maximum brightness with the hue of the first color (red) is brightness a V3+V4 at the saturation 0. When the first sub-pixel maximum brightness is represented by V1, the maximum brightness increases when the saturation is in a range from 0 to S4, becomes a brightness V1+V4 at the saturation S4, and becomes the brightness V1+V4 when the saturation is in a range from S4 to S1. The maximum brightness then decreases from the saturation S1 toward the saturation S0 as the maximum value of the saturation. The maximum brightness is the first sub-pixel maximum brightness V1 at the saturation S0. The saturation S1 is larger than the saturation S3.

As indicated by the line segment L2, in a case in which the brightness is not limited, the maximum brightness with the hue of the second color (green) is the brightness V3+V4 at the saturation 0. When the second sub-pixel maximum brightness is represented by V2, the maximum brightness increases when the saturation is in a range from 0 to S5, becomes a brightness V2+V4 at the saturation S5, and becomes the brightness V2+V4 when the saturation is in a range from S5 to S2. The maximum brightness then decreases from the saturation S2 toward the saturation S0 as the maximum value of the saturation. The maximum brightness is the second sub-pixel maximum brightness V2 at the saturation S0. The saturation S2 is larger than the saturation S1. The saturation S5 is larger than the saturation S4.

As described above, the line segment L3 takes the same value as the line segment L0. Accordingly, the maximum brightness with the hue of the third color (blue) in a case in which the brightness is not limited is the same as the maximum brightness in the standard color space.

The expanded color space storage unit 24 stores the value of the maximum brightness corresponding to the saturation in a case in which the color of the hue of the first color (red) is displayed without limiting the maximum brightness as indicated by the line segment L1. The expanded color space storage unit 24 stores the value of the maximum brightness corresponding to the saturation in a case in which the color of the hue of the second color (green) is displayed without limiting the maximum brightness as indicated by the line segment L2. The expanded color space storage unit 24 stores the value of the maximum brightness corresponding to the saturation in a case in which the color of the hue of the third color (blue) is displayed without limiting the maximum brightness as indicated by the line segment L3. By being written with these pieces of data calculated as experiment data or these pieces of data calculated through inspection when a product is shipped and the like, the expanded color space storage unit 24 stores the value of the maximum brightness corresponding to the saturation with the hues of the first color, the second color, and the third color. The expanded color space storage unit 24 calculates the value of the maximum brightness corresponding to the saturation with each hue by combining the values of the maximum brightness corresponding to the saturation with the hues of the first color, the second color, and the third color, and stores the color space not exceeding the maximum brightness as the expanded color space. The expanded color space storage unit 24 may store a value smaller than the value of the maximum brightness indicated by the line segment L1 or the line segment L2 corresponding to the saturation as the maximum brightness when the value of the first sub-pixel maximum brightness V1 or the second sub-pixel maximum brightness V2 is extremely large. That is, the expanded color space storage unit 24 may store, as the expanded color space, a color space in a range in which the first sub-pixel maximum brightness V1 is added to the fourth sub-pixel maximum brightness V4, in a range in which the second sub-pixel maximum brightness V2 is added to the fourth sub-pixel maximum brightness V4, and in a range in which the third sub-pixel maximum brightness V3 is added to the fourth sub-pixel maximum brightness V4. The range in which the first sub-pixel maximum brightness V1 is added to the fourth sub-pixel maximum brightness V4 herein means a range of the brightness of the first color between 0 to V1+V4. The range in which the second sub-pixel maximum brightness V2 is added to the fourth sub-pixel maximum brightness V4 means a range of the brightness of the second color between 0 to V2+V4. The range in which the third sub-pixel maximum brightness V3 is added to the fourth sub-pixel maximum brightness V4 means a range of the brightness of the third color between 0 to V3+V4. However, in this case, the maximum brightness (the upper limit value of displayable brightness) of at least one of the first color and the second color is larger than V3+V4 in the expanded color space.

FIG. 10 illustrates the value of the maximum brightness corresponding to the hue at the maximum saturation S0 in the expanded color space. In FIG. 10, the horizontal axis indicates the hue (°) , and the vertical axis indicates the brightness. The first sub-pixel 49R displays red (R) with the hue of 0° or 360°, so that the maximum brightness with the hue of 0° or 360° is the first sub-pixel maximum brightness V1. The second sub-pixel 49G displays green (G) with the hue of hue 120°, so that the maximum brightness with the hue of 120° is the second sub-pixel maximum brightness V2. The third sub-pixel 49B displays blue (B) with the hue of 240°, so that the maximum brightness with the hue of hue 240° is the third sub-pixel maximum brightness V3. That is, the maximum brightness changes with the hue in the expanded color space.

When the hue is 0° (red) to 120° (green), the maximum brightness is the first sub-pixel maximum brightness V1 to the second sub-pixel maximum brightness V2. When the hue is 120° (green) to 240° (blue), the maximum brightness is equal to or smaller than the second sub-pixel maximum brightness V2, and equal to or larger than the third sub-pixel maximum brightness V3. When the hue is 240° (blue) to 360° (red), the maximum brightness is the third sub-pixel maximum brightness V3 to the first sub-pixel maximum brightness V1.

In the expanded color space, the maximum brightness gradually changes with the hue. More specifically, a predetermined hue in a range from the hue 0° to the hue 120° is referred to as a hue H11. A predetermined hue in a range from the hue H11 to the hue 120° is referred to as a hue H12. A predetermined hue in a range from the hue 120° to the hue 240° is referred to as a hue H13. A predetermined hue in a range from the hue H13 to the hue 240° is referred to as a hue H14. A predetermined hue in a range from the hue 240° to the hue 360° is referred to as a hue H15. A predetermined hue in a range from the hue H15 to the hue 360° is referred to as a hue H16. For example, the hue H13 is the hue of a first intermediate color, and the hue H14 is the hue of a second intermediate color.

In the expanded color space, the maximum brightness at the maximum saturation is the first sub-pixel maximum brightness V1 with the hue in a range from the hue 0° to the hue H11. In the expanded color space, with the hue in a range from the hue H11 to the hue H12, the maximum brightness at the maximum saturation linearly increases from the first sub-pixel maximum brightness V1 to the second sub-pixel maximum brightness V2 with the change of the hue from H11 to H12. In the expanded color space, with the hue in a range from the hue H12 to the hue H13 through the hue 120°, the maximum brightness at the maximum saturation is the second sub-pixel maximum brightness V2.

In the expanded color space, with the hue in a range from the hue H13 to the hue H14, the maximum brightness at the maximum saturation linearly decreases from the second sub-pixel maximum brightness V2 to the third sub-pixel maximum brightness V3 with the change of the hue from H13 to H14. In the expanded color space, with the hue in a range from the hue H14 to the hue H15 through the hue 240°, the maximum brightness at the maximum saturation is the third sub-pixel maximum brightness V3.

In the expanded color space, with the hue in a range from the hue H15 to the hue H16, the maximum brightness at the maximum saturation linearly increases from the third sub-pixel maximum brightness V3 to the first sub-pixel maximum brightness V1 with the change of the hue from H15 to H16. In the expanded color space, with the hue in a range from the hue H16 to the hue 360°, the maximum brightness at the maximum saturation is the first sub-pixel maximum brightness V1.

The expanded color space storage unit 24 determines the hues H11, H12, H13, H14, H15, and H16 based on the written value of the maximum brightness corresponding to the saturation with the hues of the first color, the second color, and the third color.

In the expanded color space, as the saturation decreases from the maximum saturation S0, the maximum brightness varies according to the line segments L1, L2, and L3 for each hue. That is, the expanded color space has a shape obtained by adding, to a cylindrical shape, a substantially trapezoidal shape in which the maximum value of the brightness V decreases as the saturation S increases, part of the substantially trapezoidal shape being chipped according to the hue. The chipped part of the substantially trapezoidal shape varies based on the hue, and is based on the shape described with reference to FIGS. 9 and 10. The expanded color space storage unit 24 derives and stores the expanded color space described above based on the value of the maximum brightness corresponding to the saturation with the hues of the first color, the second color, and the third color. The image display panel 40 expands the input signal to widen the color space that can be extended from a cylindrical color space that is part of the expanded color space to the entire expanded color space, and displays the color.

Processing Operation of Display Device

The following describes a processing operation performed by the signal processing unit 20. The signal processing unit 20 receives the input signal as information of an image to be displayed input from the control device 11. The input signal includes information of the image (color) displayed at the position of each pixel.

Specifically, for the (p, q)-th pixel (where $1 \le p \le I$, $1 \le q \le Q_0$), signals including the input signal of the first sub-pixel having a signal value of $x_{1-(p,\ q)}$, the input signal of the second sub-pixel having a signal value of $x_{2-(p,\ q)}$, and the input signal of the third sub-pixel having a signal value of $x_{3-(p,\ q)}$ are input to the signal processing unit 20.

The signal processing unit 20 processes the input signals to generate the output signal of the first sub-pixel (signal value $X_{1-(p,\ q)}$) for determining the display gradation of the first sub-pixel 49R, the output signal of the second sub-pixel (signal value $X_{2-(p,\ q)}$) for determining the display gradation of the second sub-pixel 49G, the output signal of the third sub-pixel (signal value $X_{3-(p,\ q)}$) for determining the display gradation of the third sub-pixel 49B, and the output signal of the fourth sub-pixel (signal value $X_{4-(p,\ q)}$) for determining the display gradation of the fourth sub-pixel 49W, and outputs the output signals to the image display panel driving unit 30.

First, the signal processing unit 20 causes the color data calculation unit 22 to obtain the hue H, the saturation S, and the brightness V(S) for a plurality of pixels 48 based on the input signal values of the sub-pixels 49 of the pixels 48.

The saturation S and the brightness V(S) are represented as S=(Max−Min)/Max and V(S)=Max. The saturation S can take a value from 0 to 1, the brightness V(S) can take a value from 0 to $(2^n-1)$, and n is a display gradation bit number. Max is a maximum value among the input signal values of three sub-pixels to the pixel, that is, the input signal value of the first sub-pixel, the input signal value of the second sub-pixel, and the input signal value of the third sub-pixel. Min is a minimum value among the input signal values of three sub-pixels to the pixel, that is, the input signal value of the first sub-pixel, the input signal value of the second sub-pixel, and the input signal value of the third sub-pixel.

Typically, in the (p, q)-th pixel, the saturation $S_{(p,\ q)}$, the brightness (Value) $V(S)_{(p,\ q)}$, and the hue $H_{(p,\ q)}$ in the cylindrical HSV color space can be obtained through the following expressions (1) to (3) based on the input signal of the first sub-pixel 49R (signal value $x_{1-(p,\ q)}$), the input signal of the second sub-pixel 49G (signal value $x_{2-(p,\ q)}$, and the input signal of the third sub-pixel 49B (signal value $x_{3-(p,\ q)}$).

$$S(p, q) = (\mathrm{Max}_{(p,q)} - \mathrm{Min}_{(p,q)}) / \mathrm{Max}_{(p,q)} \quad (1)$$

$$V(S)_{(p,q)} = \mathrm{Max}_{(p,q)} \quad (2)$$

$$H = \begin{cases} \text{undefined}, & \text{if } \mathrm{Min}_{(p,q)} = \mathrm{Max}_{(p,q)} \\ 60 \times \dfrac{x_{2-(p,q)} - x_{1-(p,q)}}{\mathrm{Max}_{(p,q)} - \mathrm{Min}_{(p,q)}} + 60, & \text{if } \mathrm{Min}_{(p,q)} = x_{3-(p,q)} \\ 60 \times \dfrac{x_{3-(p,q)} - x_{2-(p,q)}}{\mathrm{Max}_{(p,q)} - \mathrm{Min}_{(p,q)}} + 180, & \text{if } \mathrm{Min}_{(p,q)} = x_{1-(p,q)} \\ 60 \times \dfrac{x_{1-(p,q)} - x_{3-(p,q)}}{\mathrm{Max}_{(p,q)} - \mathrm{Min}_{(p,q)}} + 300, & \text{if } \mathrm{Min}_{(p,q)} = x_{2-(p,q)} \end{cases} \quad (3)$$

In this expression, $\mathrm{Max}_{(p, q)}$ is the maximum value among the input signal values of three sub-pixels 49, that is, $(x_{1-(p, q)}, x_{2-(p, q)}, x_{3-(p, q)})$, and $\mathrm{Min}_{(p, q)}$ is the minimum value among the input signal values of three sub-pixels 49, that is, $(x_{1-(p, q)}, x_{2-(p, q)}, x_{3-(p, q)})$. In the first embodiment, n=8 is assumed. That is, the display gradation bit number is set to be 8 (the value of display gradation is 256, that is, 0 to 255).

Next, the signal processing unit 20 causes the α calculation unit 26 to calculate, for a plurality of pixels 48, the expansion coefficient α for expanding the input signal, based on the input signal, the hue and the saturation of the color to be displayed in accordance with the input signal calculated by the color data calculation unit 22, and the expanded color space.

More specifically, the signal processing unit 20 causes the α calculation unit 26 to multiply the signal value of the input signal by the set expansion coefficient α0 to calculate the first comparison signal value. The signal processing unit 20 causes the α calculation unit 26 to set the set expansion coefficient α0 to be the expansion coefficient α when the brightness of the color corresponding to the first comparison signal value does not exceed the upper limit value of the brightness in the expanded color space. When the brightness of the color corresponding to the first comparison signal value exceeds the upper limit value of the brightness in the expanded color space, the signal processing unit 20 causes the α calculation unit 26 to calculate the expansion coefficient α so that the brightness of the color corresponding to the second comparison signal value calculated by multiplying the signal value of the input signal by the expansion coefficient α does not exceed the upper limit value of the brightness in the expanded color space. That is, when the brightness of the color corresponding to the first comparison signal value exceeds the upper limit value of the brightness in the expanded color space, the signal processing unit 20 calculates the expansion coefficient α through the following expression (4).

$$\alpha = V\mathrm{max}(S)/V(S) \quad (4)$$

In this expression, Vmax(S) is the maximum brightness in the expanded color space, and has a different value for each hue. The signal processing unit 20 reads out the maximum brightness Vmax(S) of each pixel 48 from the data of the expanded color space stored by the expanded color space storage unit 24 based on the hue H calculated by the color data calculation unit 22.

Next, the signal processing unit 20 causes the W-conversion unit 27 to calculate the output signal value $X_{4-(p, q)}$ of the fourth sub-pixel based on at least the input signal of the first sub-pixel (signal value $x_{1-(p, q)}$), the input signal of the second sub-pixel (signal value $x_{2-(p, q)}$). and the input signal of the third sub-pixel (signal value $x_{3-(p, q)}$). More specifically, the signal processing unit 20 causes the W-conversion unit 27 to obtain the output signal value $X_{4-(p, q)}$ of the fourth sub-pixel based on a product of $\mathrm{Min}_{(p, q)}$ and the expansion coefficient α. Specifically, the signal processing unit 20 can obtain the signal value $X_{4-(p, q)}$ based on the following expression (5). In the expression (5), the product of $\mathrm{Min}_{(p, q)}$ and the expansion coefficient α is divided by χ. However, the embodiment is not limited thereto. Description of χ will be provided later.

$$X_{4-(p, q)} = \mathrm{Min}_{(p, q)} \cdot \alpha / \chi \quad (5)$$

In this expression, χ is a constant depending on the display device 10. The color filter may be provided to the fourth sub-pixel 49W that displays white. When a signal having a value controlled to be a maximum signal value of the output signal of the third sub-pixel 49B is input to the first sub-pixel 49R as the output signal of the first sub-pixel 49R, a signal having a value controlled to be the maximum signal value of the output signal of the third sub-pixel 49B is input to the second sub-pixel 49G as the output signal of the second sub-pixel 49G, and a signal having a value corresponding to the maximum signal value of the output signal of the third sub-pixel 49B is input to the third sub-pixel 49B, the luminance of an aggregate of the first sub-pixel 49R, the second sub-pixel 49G, and the third sub-pixel 49B included in the pixel 48 or a group of the pixels 48 is represented by $BN_{1-3}$. The luminance of the fourth sub-pixel 49W is represented by $BN_4$ in a case in which a signal having a value corresponding to the maximum signal value of the output signal of the fourth sub-pixel 49W is input to the fourth sub-pixel 49W included in the pixel 48 or a group of the pixels 48. That is, white with the maximum luminance is displayed by the aggregate of the first sub-pixel 49R, the second sub-pixel 49G, and the third sub-pixel 49B, and the luminance of white is represented as $BN_{1-3}$. When χ is a constant depending on the display device 10, the constant χ is given by $\chi = BN_4/BN_{1-3}$.

Specifically, the luminance $BN_4$ in a case in which the input signal having a display gradation value of 255 is assumed to be input to the fourth sub-pixel 49W is 1.5 times the luminance $BN_{1-3}$ of white in a case in which the signal value $x_{1-(p, q)}=255$, the signal value $x_{2-(p, q)}=255$, and the signal value $x_{3-(p, q)}=255$ are input to the aggregate of the first sub-pixel 49R, the second sub-pixel 49G, and the third sub-pixel 49B as input signals having the above display gradation value. That is, χ=1.5 in the first embodiment.

Next, the signal processing unit 20 causes the expansion processing unit 28 to calculate the output signal of the first sub-pixel (signal value $X_{1-(p, q)}$) based on at least the input signal of the first sub-pixel (signal value $x_{1-(p, q)}$) and the expansion coefficient α, calculate the output signal of the second sub-pixel (signal value $X_{2-(p, q)}$) based on at least the input signal of the second sub-pixel (signal value $x_{2-(p, q)}$) and the expansion coefficient α, and calculate the output signal of the third sub-pixel (signal value $X_{3-(p, q)}$) based on at least the input signal of the third sub-pixel (signal value $x_{3-(p, q)}$) and the expansion coefficient α.

Specifically, the signal processing unit 20 calculates the output signal of the first sub-pixel based on the input signal of the first sub-pixel, the expansion coefficient α, and the output signal of the fourth sub-pixel, calculates the output signal of the second sub-pixel based on the input signal of the second sub-pixel, the expansion coefficient α, and the output signal of the fourth sub-pixel, and calculates the output signal of the third sub-pixel based on the input signal of the third sub-pixel, the expansion coefficient α, and the output signal of the fourth sub-pixel.

That is, assuming that χ is a constant depending on the display device, the signal processing unit 20 obtains the output signal value $X_{1-(p,q)}$ of the first sub-pixel, the output signal value $X_{2-(p,q)}$ of the second sub-pixel, and the output signal value $X_{3-(p,q)}$ of the third sub-pixel for the (p, q)-th pixel (or a group of the first sub-pixel 49R, the second sub-pixel 49G, and the third sub-pixel 49B) using the following expressions (6), (7), and (8).

$$X_{1-(p,q)}=\alpha x_{1-(p,q)}-\chi X_{4-(p,q)} \quad (6)$$

$$X_{2-(p,q)}=\alpha x_{2-(p,q)}-\chi X_{4-(p,q)} \quad (7)$$

$$X_{3-(p,q)}=\alpha x_{3-(p,q)}-\chi X_{4-(p,q)} \quad (8)$$

In this way, the signal processing unit 20 generates the output signal for each sub-pixel 49. The following describes a method of obtaining the output signals of the (p, q)-th pixel 48, that is, the signal values of $X_{1-(p,q)}$, $X_{2-(p,q)}$, $X_{3-(p,q)}$, and $X_{4-(p,q)}$(expansion processing). The following processing is performed while maintaining a ratio among the luminance of a first primary color displayed by (first sub-pixel 49R+fourth sub-pixel 49W), the luminance of a second primary color displayed by (second sub-pixel 49G+fourth sub-pixel 49W), and the luminance of a third primary color displayed by (third sub-pixel 49B+fourth sub-pixel 49W). The processing is performed while keeping (maintaining) a color tone. Additionally, the processing is performed while keeping (maintaining) a gradation-luminance characteristic (gamma characteristic; Y characteristic). When all of the input signal values are 0 or small in any of the pixels 48 or any group of the pixels 48, the expansion coefficient α may be obtained while such a pixel 48 or a group of the pixels 48 is excluded in this calculation.

First Process

First, the signal processing unit 20 obtains the hue H, the saturation S, and the brightness V(S) for a plurality of pixels 48 based on the input signal values of the sub-pixels 49 of the pixels 48. Specifically, the signal processing unit 20 obtains the saturation $S_{(p,q)}$, the brightness $V(S)_{(p,q)}$, and the hue $H_{(p,q)}$ through the expressions (1), (2), and (3) based on the signal value $x_{1-(p,q)}$ as the input signal of the first sub-pixel 49R to the (p, q)-th pixel 48, the signal value $x_{2-(p,q)}$ as the input signal of the second sub-pixel 49G, and the signal value $x_{3-(p,q)}$ as the input signal of the third sub-pixel 49B. The signal processing unit 20 performs this processing on all of the pixels 48.

Second Process

Subsequently, the signal processing unit 20 calculates the expansion coefficient α based on the expanded color space and the calculated hue H, saturation S, and brightness V(S) for the pixels 48. Specifically, the signal processing unit 20 causes the α calculation unit 26 to calculate the first comparison signal value by multiplying the signal value of the input signal by the set expansion coefficient α0. When the brightness of the color corresponding to the first comparison signal value does not exceed the upper limit value of the brightness in the expanded color space, the signal processing unit 20 causes the α calculation unit 26 to set the set expansion coefficient α0 to be the expansion coefficient α. When the brightness of the color corresponding to the first comparison signal value exceeds the upper limit value of the brightness in the expanded color space, the signal processing unit 20 calculates the expansion coefficient α through the expression (4) so that the brightness of the color corresponding to the second comparison signal value calculated by multiplying the signal value of the input signal by the expansion coefficient α does not exceed the upper limit value of the brightness in the expanded color space. The signal processing unit 20 may acquire the expansion coefficient α through setting by an operator or an input by the control device 11 without calculating the expansion coefficient α.

Third Process

Next, the signal processing unit 20 obtains the signal value $X_{4-(p,q)}$ for the (p, q)-th pixel 48 based on at least the signal value $x_{1-(p,q)}$, the signal value $x_{2-(p,q)}$, and the signal value $x_{3-(p,q)}$. In the first embodiment, the signal processing unit 20 determines the signal value $X_{1-(p,q)}$ based on $Min_{(p,q)}$, the expansion coefficient α, and the constant χ. More specifically, as described above, the signal processing unit 20 obtains the signal value $X_{4-(p,q)}$ based on the expression (5) described above. The signal processing unit 20 obtains the signal value $X_{4-(p,q)}$ for all of the $P_0 \times Q_0$ pixels 48.

Fourth Process

Subsequently, the signal processing unit 20 obtains the signal value $X_{1-(p,q)}$ for the (p, q)-th pixel 48 based on the signal value $x_{1-(p,q)}$, the expansion coefficient α, and the signal value $X_{4-(p,q)}$, obtains the signal value $X_{2-(p,q)}$ for the (p, q)-th pixel 48 based on the signal value $x_{2-(p,q)}$, the expansion coefficient α, and the signal value $X_{4-(p,q)}$, and obtains the signal value $X_{3-(p,q)}$ for the (p, q)-th pixel 48 based on the signal value $x_{3-(p,q)}$, the expansion coefficient α, and the signal value $X_{4-(p,q)}$. Specifically, the signal processing unit 20 obtains the signal value $X_{1-(p,q)}$, the signal value $X_{2-(p,q)}$, and the signal value $X_{3-(p,q)}$ for the (p, q)-th pixel 48 based on the expressions (6) to (8) described above.

Figure 11:
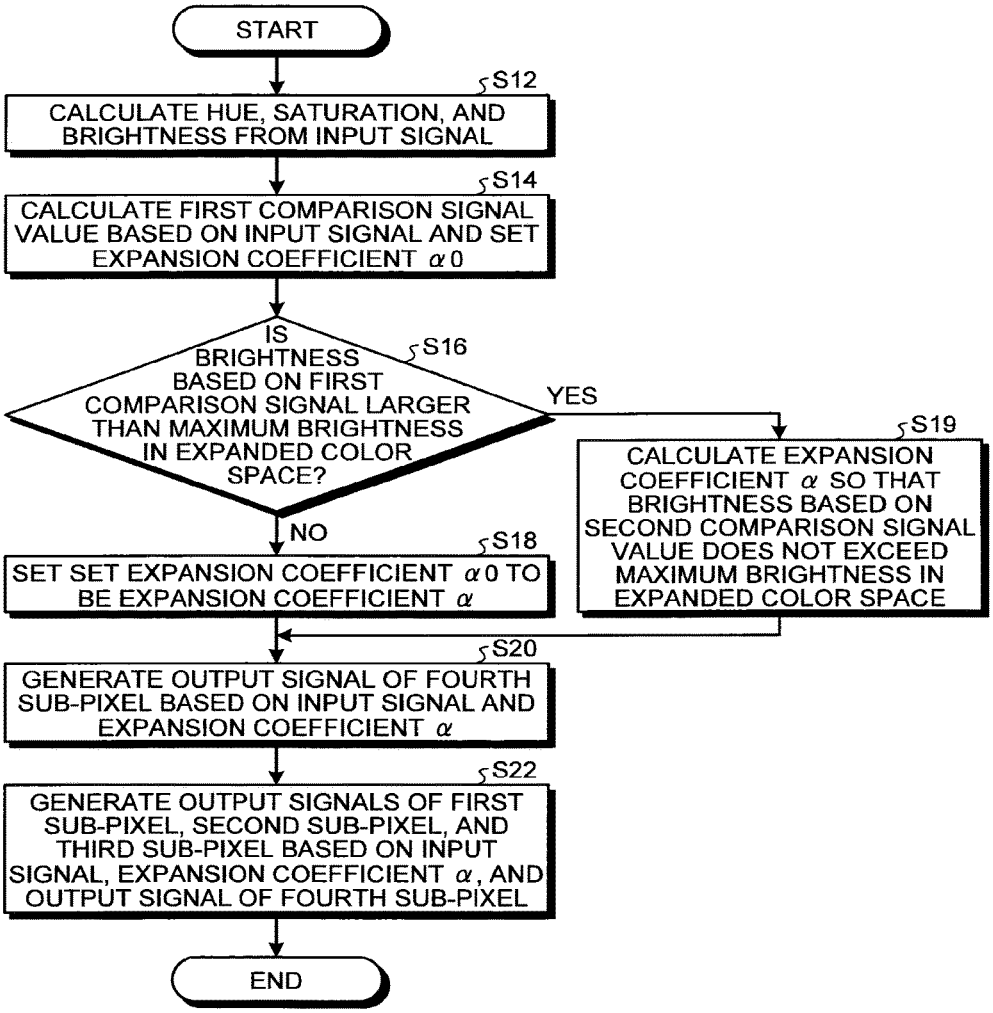
FIG. 11 is a flowchart of processing of generating an output signal of each sub-pixel performed by the signal processing unit according to the first embodiment.

The following describes the processing of generating the output signal of each sub-pixel 49 performed by the signal processing unit 20 described in the first process to the fourth process based on a flowchart. FIG. 11 is a flowchart of the processing of generating the output signal of each sub-pixel performed by the signal processing unit according to the first embodiment.

As illustrated in FIG. 11, to generate the output signal of each sub-pixel 49, the signal processing unit 20 first causes the color data calculation unit 22 to obtain the hue H, the saturation S, and the brightness V(S) for the pixels 48 based on the input signal input from the control device 11 (Step S12). Specifically, the signal processing unit 20 obtains the saturation $S_{(p,q)}$, the brightness $V(S)_{(p,q)}$, and the hue $H(S)_{(p,q)}$ through the expressions (1), (2), and (3).

After obtaining the hue H, the saturation S, and the brightness V(S), the signal processing unit 20 causes the α calculation unit 26 to calculate the first comparison signal value based on the input signal and the set expansion coefficient α0 (Step S14). The signal processing unit 20 causes the α calculation unit 26 to calculate the first comparison signal value by multiplying the signal value of the input signal by the set expansion coefficient α0. That is, the signal processing unit 20 multiplies each of the signal value $X_{1-(p,q)}$, the signal value $x_{2-(p,q)}$, and the signal value $x_{3-(p,q)}$ by the set expansion coefficient α0 to calculate the first comparison signal value. The signal processing unit 20 then calculates the brightness of the color based on the first comparison signal calculated from the first comparison signal value.

After calculating the first comparison signal value, the signal processing unit 20 causes the α calculation unit 26 to determine whether the brightness of the color based on the first comparison signal is larger than the maximum brightness Vmax(S) in the expanded color space (Step S16). The signal processing unit 20 causes the α calculation unit 26 to read out the maximum brightness Vmax(S) in the expanded color space with the obtained hue H. The signal processing unit 20 then causes the α calculation unit 26 to compare the magnitude of the read maximum brightness Vmax(S) in the expanded color space with the magnitude of the brightness of the color based on the first comparison signal.

When the brightness of the color based on the first comparison signal is smaller than the maximum brightness Vmax(S) in the expanded color space (No at Step S16), the signal processing unit 20 causes the α calculation unit 26 to set the set expansion coefficient α0 to be the expansion coefficient α (Step S18). That is, the color to be displayed can be extended in the expanded color space even when the input signal is expanded with the set expansion coefficient α0 set in advance, so that the signal processing unit 20 causes the set expansion coefficient α0 set in advance to be the expansion coefficient α without adjusting the expansion coefficient α.

When the brightness of the color based on the first comparison signal is smaller than the maximum brightness Vmax(S) in the expanded color space (Yes at Step S16), the signal processing unit 20 causes the α calculation unit 26 to calculate the expansion coefficient α so that the brightness of the color based on the second comparison signal value does not exceed the maximum brightness Vmax(S) in the expanded color space (Step S19). The second comparison signal value is obtained by multiplying the expansion coefficient α by the signal value of the input signal. The signal processing unit 20 causes the α calculation unit 26 to calculate the expansion coefficient α so that the brightness of the color based on the second comparison signal does not exceed the maximum brightness Vmax(S) in the expanded color space. Specifically, the signal processing unit 20 causes the α calculation unit 26 to calculate the expansion coefficient α based on the expression (4).

After calculating the expansion coefficient α, the signal processing unit 20 causes the W-conversion unit 27 to generate the output signal of the fourth sub-pixel based on the signal value of the input signal and the expansion coefficient α (Step S20). As described above, the signal processing unit 20 obtains the output signal value $X_{4-(p,\ q)}$of the fourth sub-pixel based on the expression (5).

After generating the output signal of the fourth sub-pixel, the signal processing unit 20 causes the expansion processing unit 28 to generate the output signals of the first sub-pixel 49R, the second sub-pixel 49G, and the third sub-pixel 49B based on the signal value of the input signal, the expansion coefficient α, and the output signal of the fourth sub-pixel (Step S22). The signal processing unit 20 obtains the output signal value $X_{1-(p,\ q)}$, of the first sub-pixel, the output signal value $X_{2-(p,\ q)}$ of the second sub-pixel, and the output signal value $X_{3-(p,\ q)}$ of the third sub-pixel of the (p, q)-th pixel 48 based on the expressions (6) to (8) described above. This ends the processing of generating the output signal of each sub-pixel 49 performed by the signal processing unit 20.

As described above, in the display device 10 according to the first embodiment, the signal processing unit 20 stores the expanded color space. The display device 10 can expand the color to be displayed by the image display panel 40 to the color that can be expressed in the expanded color space with the signal processing unit 20. As described above, the expanded color space is a color space that can be extended when the maximum brightness of each sub-pixel 49 is not limited which has been limited according to the element characteristic of each sub-pixel 49. Thus, the display device 10 according to the first embodiment can display the color the brightness of which is higher than that of the color in the standard color space, so that the image having high brightness can be appropriately displayed.

In the display device 10, the upper limit value of the brightness of a displayable color based on the expanded color space is different for each hue. Accordingly, when the color the brightness of which is higher than that of the color in the standard color space is displayed, the display device 10 displays the color in a displayable range for each hue. Thus, the display device 10 can prevent gradation collapse, so that the image having high brightness can be appropriately displayed.

In the display device 10, when the hue of the color to be displayed is a hue between the hue of any one of the first color, the second color, and the third color and the hue of one of the others, the maximum brightness has a value between the maximum brightness of the one color and the maximum brightness of the one of the other colors. For example, in the display device 10, when the hue of the color to be displayed is a hue between the second color (green) and the third color (blue) (a hue between the hue 120° and the hue 240° in FIG. 10), the maximum brightness is the third sub-pixel maximum brightness V3 to the second sub-pixel maximum brightness V2. Thus, the display device 10 can appropriately display the image having high brightness while preventing gradation collapse with any hue.

In the display device 10, the maximum brightness of the color to be displayed gradually changes with the hue of the color to be displayed. Thus, the display device 10 can appropriately display the image having high brightness while preventing gradation collapse with any hue.

Figure 12:
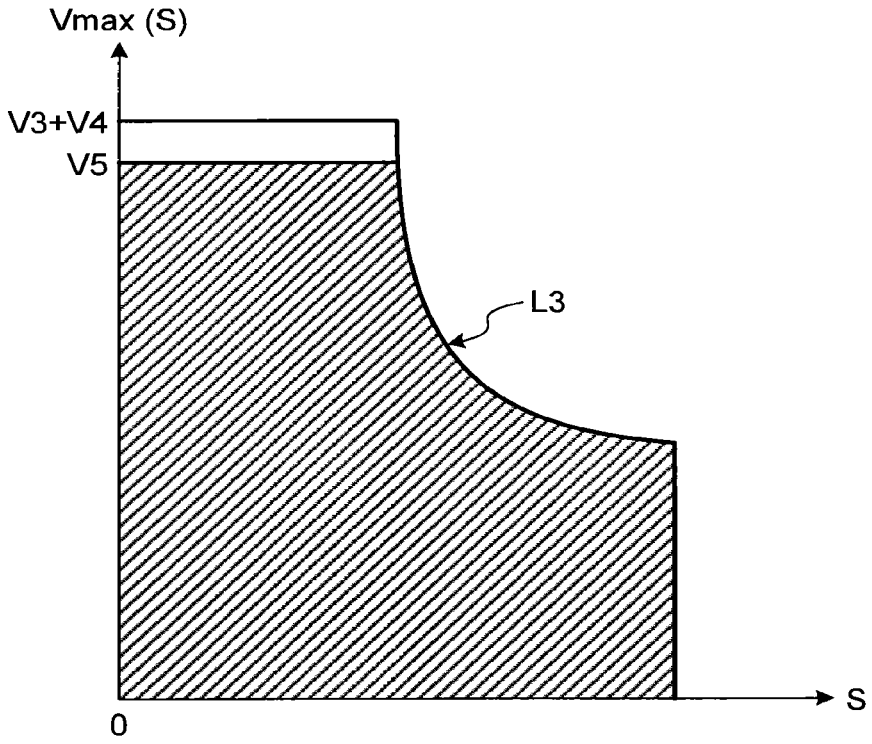
FIG. 12 is a conceptual diagram for explaining a color space in a case in which a maximum brightness is limited.

In the first embodiment, to display white having the maximum brightness, as illustrated in FIG. 9, the display device 10 displays white the saturation S of which is 0 and the brightness V thereof is plotted as the maximum brightness V3 +V4. In this case, the input signal of each sub-pixel 49 has a signal value of the maximum gradation, and is expanded to the maximum. However, for example, the display device 10 may limit the maximum brightness of white by a setting in some cases. FIG. 12 is a conceptual diagram for explaining the color space in a case in which the maximum brightness is limited. As illustrated in FIG. 12, the display device 10 limits the maximum brightness so that the maximum brightness of white is V5 that is smaller than V3+V4. In this case, to display white having the maximum brightness, the display device 10 causes the signal processing unit 20 to generate a specified output signal obtained by limiting the output signal value, which is the input signal value of the maximum gradation being expanded to the maximum, so that the maximum brightness of white is V5.

However, even in such a case, to display the color other than white, the display device 10 can expand the maximum brightness to the brightness that is equal to or larger than V5 within the expanded color space. In this case, in addition to the first sub-pixel 49R and the second sub-pixel 49G, the third sub-pixel 49B can also expand the brightness to be equal to or larger than the set brightness V5.

Second Embodiment

The following describes a second embodiment of the present invention. A display device 10*a* according to the second embodiment is different from the display device 10 according to the first embodiment in that a pixel includes the first sub-pixel, the second sub-pixel, and the third sub-pixel, but not the fourth sub-pixel. The configuration of the display device 10*a* according to the second embodiment is the same as that of the display device 10 according to the first embodiment except for the fourth sub-pixel, so that redundant description will not be repeated.

Figure 13:
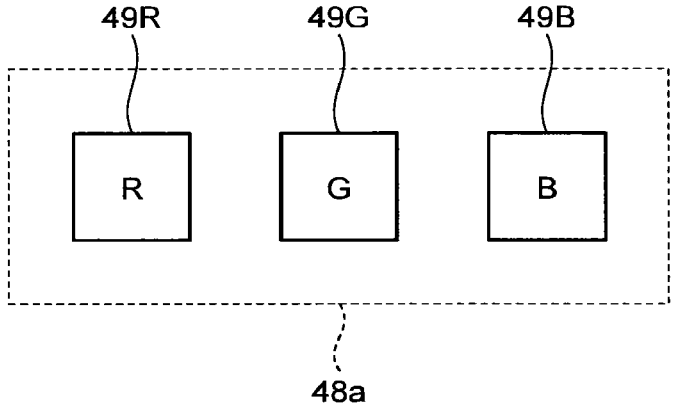
FIG. 13 is a diagram illustrating an array of sub-pixels of an image display panel according to a second embodiment.

FIG. 13 is a diagram illustrating an array of sub-pixels of the image display panel according to the second embodiment. As illustrated in FIG. 13, a pixel 48*a* included in this image display panel 40*a* according to the second embodiment includes the first sub-pixel 49R, the second sub-pixel 49G, and the third sub-pixel 49B. The image display panel 40*a* according to the second embodiment does not include the fourth sub-pixel 49W.

Figure 14:
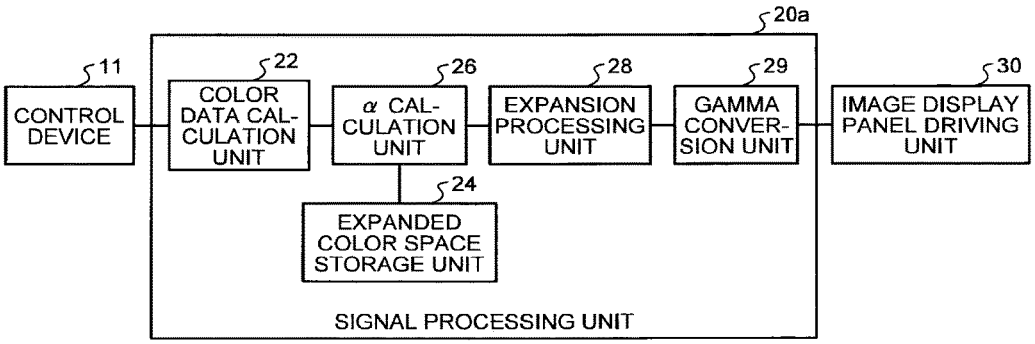
FIG. 14 is a block diagram illustrating the configuration of a signal processing unit according to the second embodiment.

FIG. 14 is a block diagram illustrating the configuration of the signal processing unit according to the second embodiment. As illustrated in FIG. 14, unlike the signal processing unit 20 according to the first embodiment illustrated in FIG. 6, a signal processing unit 20*a* according to the second embodiment does not include the W-conversion unit. The signal processing unit 20*a* outputs the input value of the input signal displayed by combining the colors of red, green, and blue as a signal value of red, green, and blue without converting the input value into a signal value of red, green, blue, and white.

Figure 15:
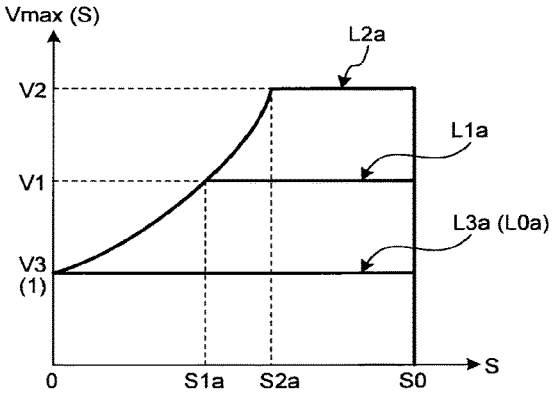
FIG. 15 is a conceptual diagram illustrating a relation between the saturation and the brightness with each hue in an expanded color space according to the second embodiment.

The following describes the expanded color space stored by the signal processing unit 20*a* according to the second embodiment. FIG. 15 is a conceptual diagram illustrating a relation between the saturation and the brightness with each hue in the expanded color space according to the second embodiment. When the white component of the fourth sub-pixel 49W is not added, the standard color space is the cylindrical HSV color space as illustrated in FIG. 7. That is, the standard color space is a color space within the maximum brightness indicated by a line segment L0*a* in FIG. 15. As indicated by the line segment L0*a*, in the standard color space in this case, the maximum brightness is the third sub-pixel maximum brightness V3 irrespective of the saturation.

A line segment L1*a* in FIG. 15 indicates the maximum brightness corresponding to the saturation in a case of displaying the color of the hue of the first color (red) with only the first sub-pixel 49R without limiting the maximum brightness. That is, the line segment L1*a*indicates the upper limit value of the color space extended with the hue of the first color (red) in a case of outputting the output signal for displaying the color of the first sub-pixel maximum brightness to the first sub-pixel 49R by expanding the input signal.

A line segment L2*a* in FIG. 15 indicates the maximum brightness corresponding to the saturation in a case of displaying the color of the hue of the second color (green) with only the second sub-pixel 49G without limiting the maximum brightness. That is, the line segment L2*a* indicates the upper limit value of the color space extended with the hue of the second color (green) in a case of outputting the output signal for displaying the color of the second sub-pixel maximum brightness to the second sub-pixel 49G by expanding the input signal.

A line segment L3*a* in FIG. 15 indicates the maximum brightness corresponding to the saturation in a case of displaying the color of the hue of the third color (blue) with only the third sub-pixel 49B without limiting the maximum brightness. That is, the line segment L3*a*indicates the upper limit value of the color space extended with the hue of the third color (blue) in a case of outputting the output signal for displaying the color of the third sub-pixel maximum brightness to the third sub-pixel 49B. The line segment L3*a* corresponds to the third sub-pixel maximum brightness, so that the line segment C3*b* is the same as the line segment L0*a* of the standard color space.

As indicated by the line segment L1*a*, in a case in which the brightness is not limited, the maximum brightness of the hue of the first color (red) is the first sub-pixel maximum brightness $V_1$ when the saturation is in a range from $S_0$ to $S_{1a}$. The maximum brightness decreases as the saturation decreases from the saturation $S_{1a}$ to the saturation 0. The maximum brightness is the third sub-pixel maximum brightness $V_3$ at the saturation 0.

As indicated by the line segment L2*a*, in a case in which the brightness is not limited, the maximum brightness of the hue of the second color (green) is the second sub-pixel maximum brightness $V_2$ when the saturation is in a range from $S_0$ to $S_{2a}$. The maximum brightness decreases as the saturation decreases from the saturation $S_{2a}$ to the saturation 0. The maximum brightness is the third sub-pixel maximum brightness $V_3$ at the saturation 0.

As described above, the line segment L3*a* takes the same value as the line segment L0*a*. Accordingly, in a case in which the brightness is not limited, the maximum brightness with the hue of the third color (blue) is the same as the maximum brightness in the standard color space.

In the expanded color space according to the second embodiment, the maximum brightness with the hues of the first color, the second color, and the third color at the saturation $S_0$ is the same value as that in the expanded color space according to the first embodiment. Thus, a relation between the saturation and the maximum brightness for each hue at the saturation $S_0$ is the same as that illustrated in FIG. 10 similarly to the first embodiment. The expanded color space storage unit 24 according to the second embodiment combines the values of the maximum brightness corresponding to the saturation with the hues of the first color, the second color, and the third color as illustrated in FIG. 15 to calculate the value of the maximum brightness corresponding to the saturation of each hue, and stores the color space within the maximum brightness as the expanded color space. Alternatively, the expanded color space storage unit 24 may store, as the expanded color space, a color space within a range of the first sub-pixel maximum brightness V1, within a range of the second sub-pixel maximum brightness V2, and within a range of the third sub-pixel maximum brightness. In this case, the "range of the first sub-pixel maximum brightness V1" means a range of the brightness of the first color between 0 to V1. The "range of the second sub-pixel maximum brightness V2" means a range of the brightness of the second color between 0 to V2. The "range of the third sub-pixel maximum brightness V3" means a range of the brightness of the third color between 0 to V3. In this case, in the expanded color space, the maximum brightness of any one of the first color and the second color (the upper limit value of displayable brightness) is larger than V3.

The display device 10*a* according to the second embodiment can expand the color displayed by the image display panel 40*a* to a color that can be extended in the expanded color space. To expand the color displayed by the image display panel 40*a* to the color that can be extended in the expanded color space, the signal processing unit 20*a* of the display device 10*a* performs processing similar to the processing performed by the signal processing unit 20 according to the first embodiment. However, the signal processing unit 20*a* does not generate the output signal of the fourth sub-pixel.

As described above, the display device 10*a* according to the second embodiment stores the data of the expanded color space in the expanded color space storage unit 24 of the signal processing unit 20*a*. The display device 10*a* determines the expansion coefficient $\alpha$ to expand the color to be displayed by an image display panel 40*a* to a color that can be extended in the expanded color space with the signal processing unit 20*a*. The display device 10*a* then generates the output signals of the first sub-pixel 49R, the second sub-pixel 49G, and the third sub-pixel 49B based on the expansion coefficient α and the input signal. A color having the brightness higher than that in the standard color space can be extended in the expanded color space. Thus, even when the fourth sub-pixel 49W is not included, the display device 10*a* according to the second embodiment can appropriately display the image having high brightness similarly to the first embodiment.

Third Embodiment

The following describes a third embodiment of the present invention. A display device 10*b* according to the third embodiment is different from the display device 10 according to the first embodiment in that the image display panel is a liquid crystal display panel. The configuration of the display device 10*b* according to the third embodiment is the same as that of the display device 10 according to the first embodiment except for the display panel, so that redundant description will not be repeated.

Figure 16:
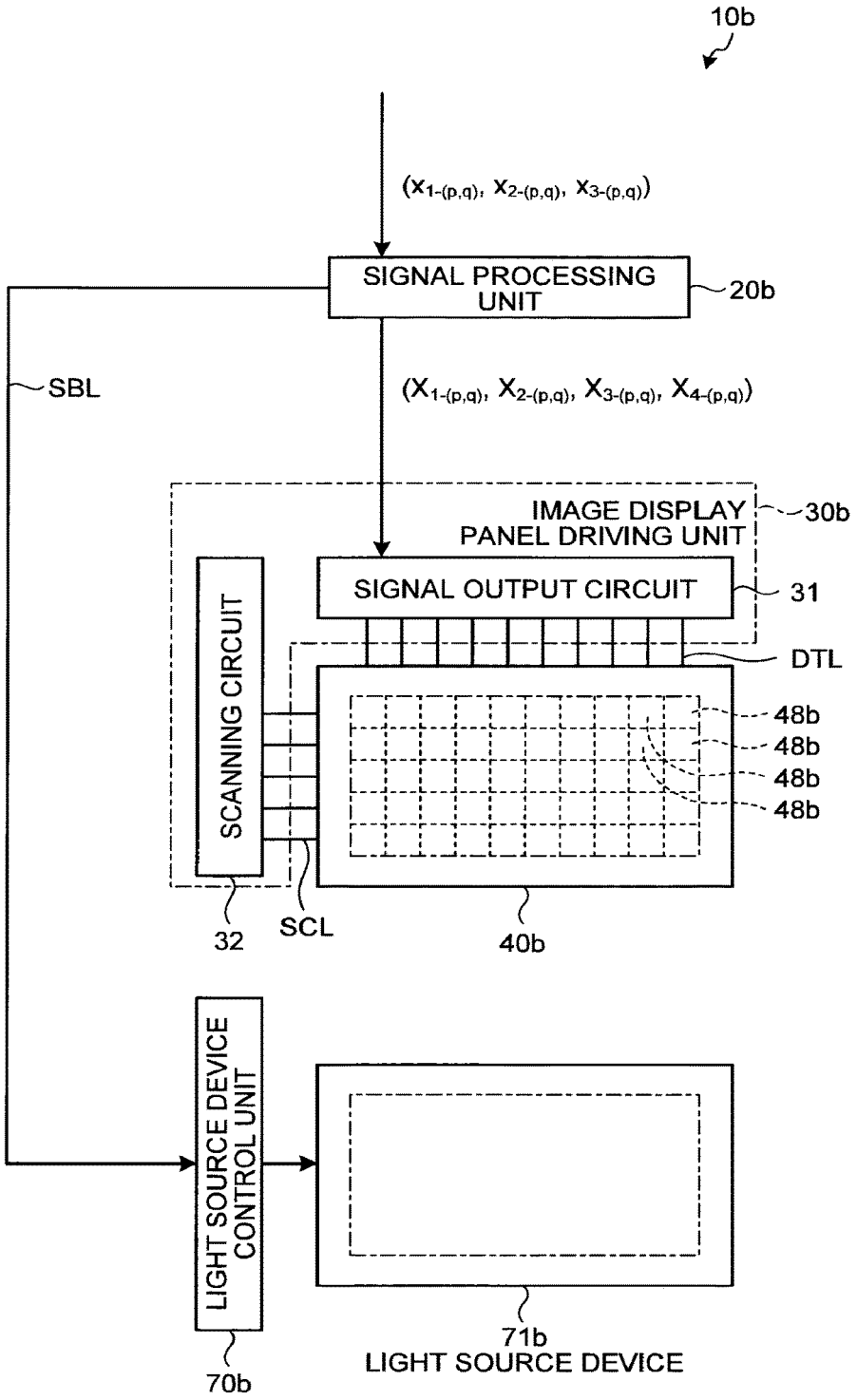
FIG. 16 is a block diagram illustrating an example of the configuration of a display device according to a third embodiment.

FIG. 16 is a block diagram illustrating an example of the configuration of the display device according to the third embodiment. As illustrated in FIG. 16, the display device 10*b* according to the third embodiment includes a signal processing unit 20*b*, an image display panel 40*b* that is a liquid crystal display panel, a light source device control unit 70*b*, and a light source device 71*b*. The display device 10*b* displays an image when the signal processing unit 20*b* transmits a signal to each unit of the display device 10*b*, the light source device control unit 70*b* controls driving of the light source device 71*b* based on the signal from the signal processing unit 20*b*, and the light source device 71*b* illuminates the image display panel 40*b* from a back surface based on the signal of the light source device control unit 70*b*.

Figure 17:
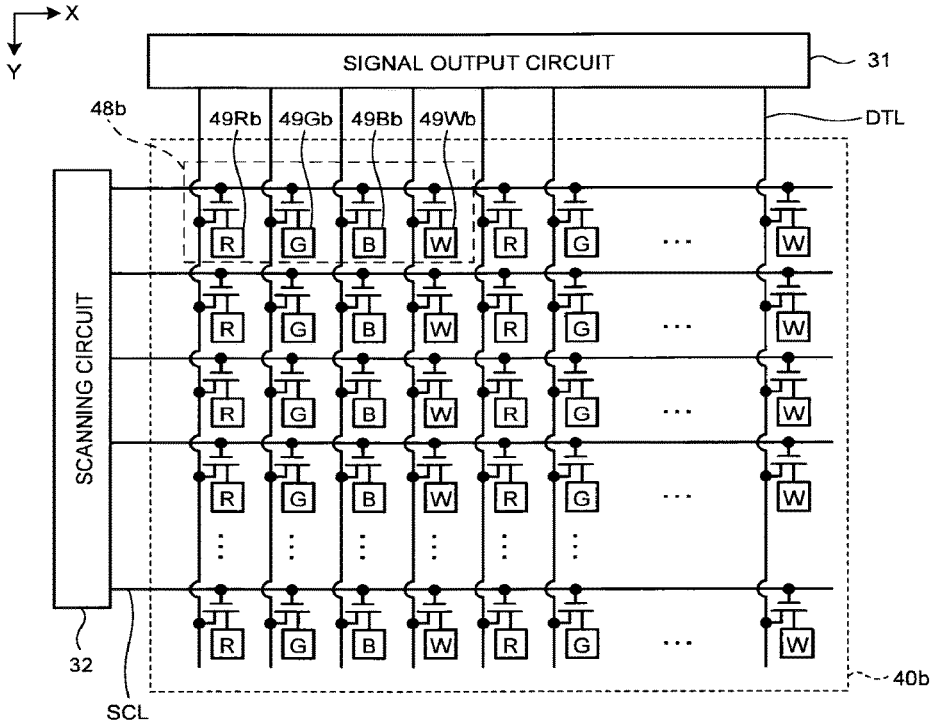
FIG. 17 is a conceptual diagram of an image display panel according to the third embodiment.

FIG. 17 is a conceptual diagram of the image display panel according to the third embodiment. In the image display panel 40*b*, as illustrated in FIG. 17, pixels 48*b* each including a first sub-pixel 49Rb that displays the first color, a second sub-pixel 49Gb that displays the second color, a third sub-pixel 49Bb that displays the third color, and a fourth sub-pixel 49Wb that displays the fourth color are arrayed in a two-dimensional matrix (rows and columns).

In the pixel 48*b*, a liquid crystal layer is arranged between two opposite electrodes. When a voltage from an image output signal is applied between the two electrodes, an electric field is generated by the two electrodes in the liquid crystal layer between the electrodes. The electric field changes a double refractive index by twisting liquid crystal elements in the liquid crystal layer. The display device 10*b* displays a predetermined image by adjusting the amount of light emitted from the light source device 71*b* according to a change in the double refractive index of the liquid crystal elements.

Figure 18:
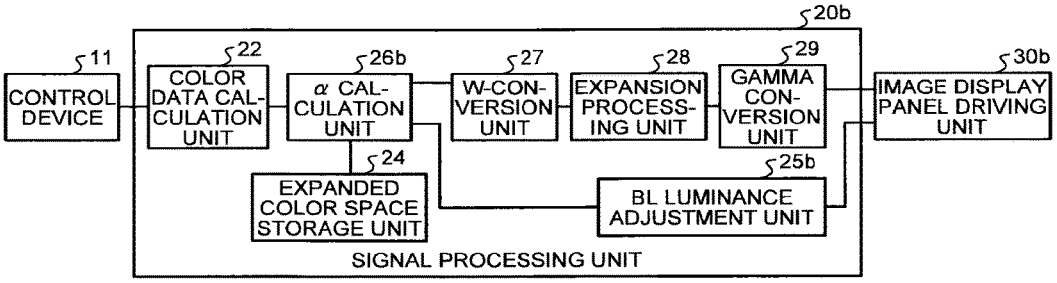
FIG. 18 is a block diagram illustrating the configuration of a signal processing unit according to the third embodiment.

FIG. 18 is a block diagram illustrating the configuration of the signal processing unit according to the third embodiment. As illustrated in FIG. 18, the signal processing unit 20*b* includes a BL luminance adjustment unit 25*b*. The signal processing unit 20*b* calculates an expansion coefficient αb, and generates the output signal from the input signal and the expansion coefficient αb. This processing performed by the signal processing unit 20*b* will be described later.

The output signal is expanded αb times. The signal processing unit 20*b* may reduce the luminance of the light source device 71*b* based on the expansion coefficient αb in some cases to set the luminance of the image to be the same as the luminance of the image that is not expanded. The display device 10*b* causes the BL luminance adjustment unit 25*b* to multiply the luminance of the light source device 71*b* by (1/αb). Due to this, the display device 10*b* can reduce power consumption of the light source device 71*b*. The signal processing unit 20*b* outputs this (1/αb) to the light source device control unit 70*b* as a light source device control signal SBL.

Specifically, the BL luminance adjustment unit 25*b* is electrically coupled to a α calculation unit 26*b*. The BL luminance adjustment unit 25*b* receives information of the expansion coefficient αb input from the α calculation unit 26. The BL luminance adjustment unit 25*b* generates a signal that multiplies the luminance of the light source device 71*b* by (1/αb) based on the expansion coefficient αb, and outputs the signal to a image display panel driving unit 30*b*.

The light source device 71*b* is arranged on the back surface of the image display panel 40*b*, controlled by the light source device control unit 70*b* to emit light toward the image display panel 40*b*, and illuminates the image display panel 40*b* to display an image. The light source device 71*b* emits light to the image display panel 40*b*.

The light source device control unit 70*b* controls the amount of light and the like output from the light source device 71*b*. Specifically, the light source device control unit 70*b* adjusts the voltage and the like supplied to the light source device 71*b* by pulse width modulation (PWM) and the like based on the light source device control signal SBL output from the signal processing unit 20*b* to control the amount of light (light intensity) that irradiates the image display panel 40*b*.

Figure 19:
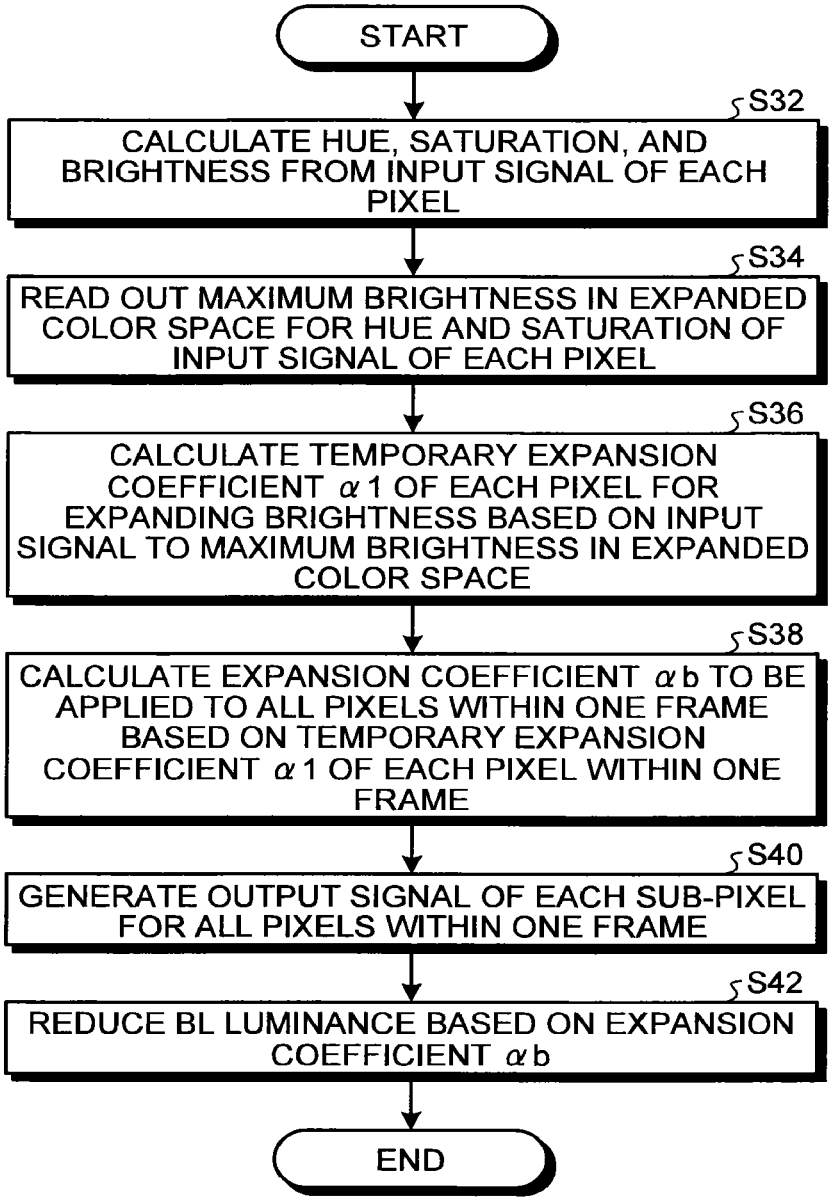
FIG. 19 is a flowchart of processing of generating an output signal and processing of reducing luminance of a light source device performed by the signal processing unit according to the third embodiment.

The following describes the processing of generating the output signal and the processing of reducing the luminance of the light source device 71*b* performed by the signal processing unit 20*b* based on a flowchart. FIG. 19 is a flowchart of the processing of generating the output signal and the processing of reducing the luminance of the light source device performed by the signal processing unit according to the third embodiment.

As illustrated in FIG. 19, the signal processing unit 20*b* first causes the color data calculation unit 22 to obtain the hue H, the saturation S, and the brightness V(S) for each pixel 48*b* based on the input signal of each pixel 48*b* (Step S32).

After obtaining the hue H, the saturation S, and the brightness V(S), the signal processing unit 20*b* causes the α calculation unit 26*b* to read out the maximum brightness Vmax(S) in the expanded color space with the hue H and the saturation S based on the input signal of each pixel 48*b* (Step S34). The α calculation unit 26*b* reads out, from the expanded color space storage unit 24, the maximum brightness Vmax(S) in the expanded color space with the hue H and the saturation S of each pixel 48*b* calculated by the color data calculation unit 22.

After reading out the maximum brightness Vmax(S) in the expanded color space, the signal processing unit 20*b* causes the α calculation unit 26*b* to calculate a temporary expansion coefficient α1 for each pixel 48*b* for expanding the brightness V(S) based on the input signal to the maximum brightness Vmax(S) in the expanded color space (Step S36). That is, the α calculation unit 26*b* calculates the temporary expansion coefficient α1 for each pixel 48*b* as a coefficient for expanding the brightness V(S) to the maximum brightness Vmax in the expanded color space through the following expression (9). The α calculation unit 26*b* calculates the temporary expansion coefficient α1 for each of the pixels 48*b* within one frame.

$$\alpha 1 = V\max(S)/V(S) \tag{9}$$

After calculating the temporary expansion coefficient al for each pixel 48*b*, the signal processing unit 20*b* causes the α calculation unit 26*b* to calculate the expansion coefficient αb to be applied to all of the pixels 48*b* within one frame based on the temporary expansion coefficient α1 of each of the pixels 48 within one frame (Step S38). Specifically, the signal processing unit 20*b* causes the α calculation unit 26*b* to set a minimum value among temporary expansion coefficients α1 for the pixels 48 within one frame to be the expansion coefficient αb. However, the method of calculating the expansion coefficient αb is not limited thereto, and is optional. For example, the signal processing unit 20*b* may determine the expansion coefficient αb so that a ratio of the pixels 48*b* in which the expanded value of brightness obtained by multiplying the brightness V(S) by the expansion coefficient αb exceeds the maximum brightness Vmax (S) to all of the pixels 48*b* is equal to or smaller than a limit value β. The limit value β is an upper limit value (ratio) of a range of exceeding the maximum brightness relative to the maximum brightness in the expanded color space with a combination of the values of the hue and the saturation.

After calculating the expansion coefficient αb, the signal processing unit 20*b* generates the output signal of each sub-pixel 49*b* in all of the pixels 48*b* within one frame (Step S40). The signal processing unit 20*b* causes the W-conversion unit 27 and the expansion processing unit 28 to generate the output signals of the first sub-pixel 49Rb, the second sub-pixel 49Gb, the third sub-pixel 49Bb, and the fourth sub-pixel 49Wb with the expansion coefficient αb using the same method as that in the first embodiment. The signal processing unit 20*b* generates the output signal of each sub-pixel 49*b* in all of the pixels 48*b* within one frame using the same expansion coefficient αb.

After generating the output signal of each sub-pixel 49*b*, the signal processing unit 20*b* causes the BL luminance adjustment unit 25*b* to reduce the luminance (BL luminance) of the light source device 71*b* based on the expansion coefficient αb (Step S42). The BL luminance adjustment unit 25*b* generates a signal that multiplies the luminance of the light source device 71*b* by (1/αb) based on the expansion coefficient αb. This ends the processing of generating the output signal and the processing of reducing the luminance of the light source device 71*b* performed by the signal processing unit 20*b*. Step S42 is not necessarily performed after generating the output signal of each sub-pixel 49*b* (after Step S40), and may be performed at the same time as Step S40 or before Step S40 so long as it is performed after the expansion coefficient αb is calculated (after Step S38).

In this way, the display device 10*b* according to the third embodiment expands the input signal based on the expansion coefficient αb. Accordingly, similarly to the display device 10 according to the first embodiment, the display device 10*b* can display the color having higher brightness than that of the color in the standard color space. The display device 10*b* can appropriately display the image having high brightness even with the liquid crystal display panel.

Fourth Embodiment

The following describes a fourth embodiment of the present invention. A display device 10*c* according to the fourth embodiment is different from the display device 10*b* according to the third embodiment in that the image display panel is a reflective liquid crystal display panel. The configuration of the display device 10*c* according to the fourth embodiment is the same as that of the display device 10*b* according to the third embodiment except for the image display panel, so that redundant description will not be repeated.

Figure 20:
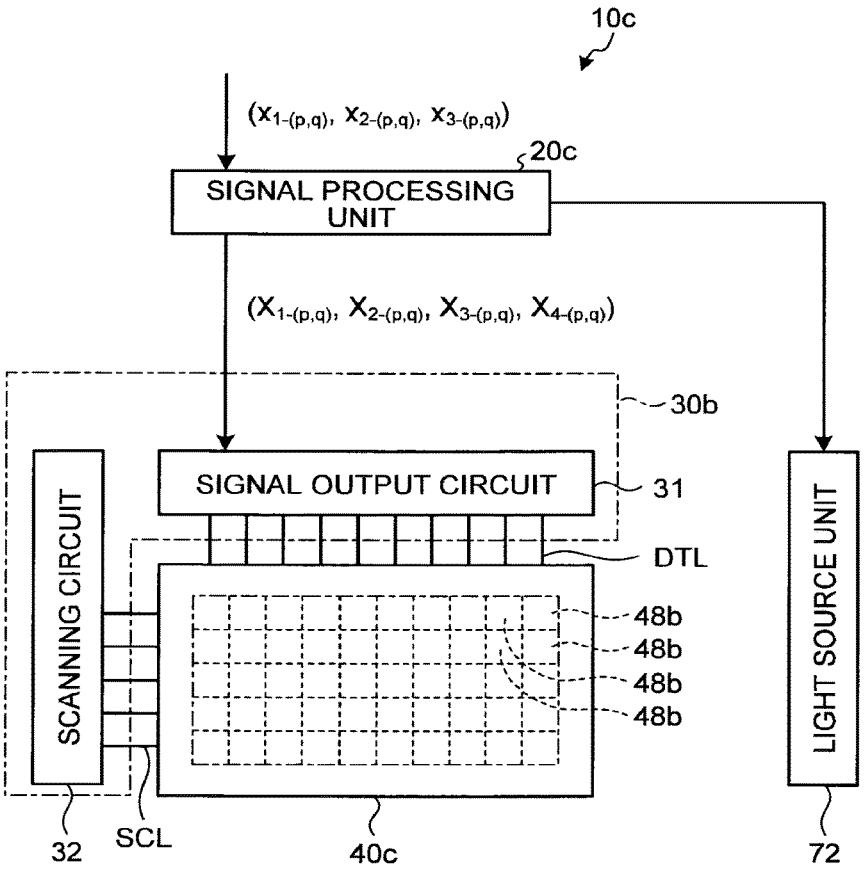
FIG. 20 is a block diagram illustrating an example of the configuration of a display device according to a fourth embodiment.

FIG. 20 is a block diagram illustrating an example of the configuration of the display device according to the fourth embodiment. As illustrated in FIG. 20, the display device 10*c* according to the fourth embodiment includes a signal processing unit 20*c*, an image display panel 40*c*, and a light source unit 72. The display device 10*c* displays an image by causing the image display panel 40*c* to reflect external light. When the display device 10*c* is used at night outdoors or used at a dark place where external light is not enough, for example, the display device 10*c* can display the image by causing the image display panel 40*c* to reflect light emitted from the light source unit 72.

Figure 21:
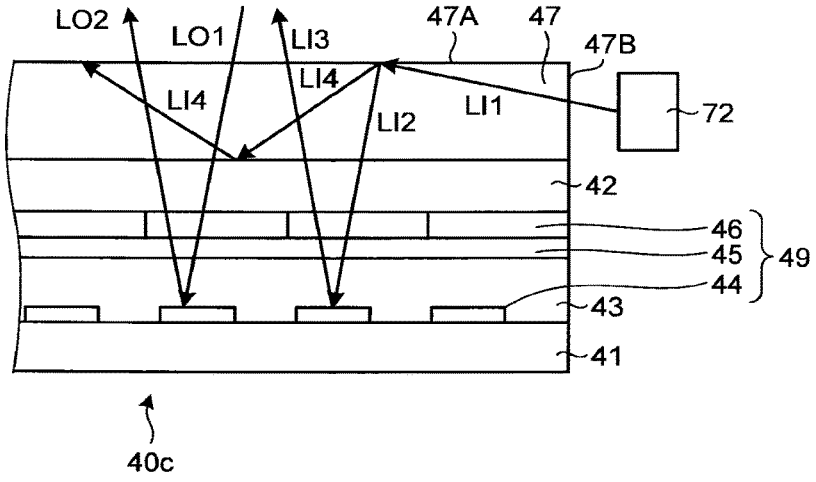
FIG. 21 is a cross-sectional view schematically illustrating the structure of an image display panel according to the fourth embodiment.

FIG. 21 is a cross-sectional view schematically illustrating the structure of the image display panel according to the fourth embodiment. As illustrated in FIG. 21, the image display panel 40*c* includes an array substrate 41 and a counter substrate 42 opposed to each other. A liquid crystal layer 43 in which liquid crystal elements are enclosed is arranged between the array substrate 41 and the counter substrate 42.

The array substrate 41 includes a plurality of pixel electrodes 44 arranged on the surface thereof facing the liquid crystal layer 43. The pixel electrode 44 is coupled to a signal line DTL via a switching element, and an image output signal as a video signal is applied thereto. The pixel electrode 44 is a reflective member made of aluminum or silver, for example, and reflects external light or light from the light source unit 72. That is, in the fourth embodiment, a reflection unit is constituted by the pixel electrode 44, and the reflection unit reflects light incident from the front surface (a surface on which the image is displayed) of the image display panel 40*c* to display the image.

The counter substrate 42 is a transparent substrate made of glass, for example. The counter substrate 42 includes a counter electrode 45 and a color filter 46 on the surface thereof facing the liquid crystal layer 43. More specifically, the counter electrode 45 is arranged on the surface of the color filter 46 facing the liquid crystal layer 43.

The counter electrode 45 is made of transparent conductive material such as indium tin oxide (ITO) or indium zinc oxide (IZO), for example. The counter electrode 45 is coupled to the switching element to which the pixel electrode 44 is coupled. The pixel electrode 44 and the counter electrode 45 are arranged to be opposed to each other, so that the pixel electrode 44 and the counter electrode 45 generate an electric field in the liquid crystal layer 43 when the voltage from the image output signal is applied between the pixel electrode 44 and the counter electrode 45. The liquid crystal elements are twisted due to the electric field generated in the liquid crystal layer 43, the double refractive index is changed, and the display device 10*c* adjusts the amount of light reflected by the image display panel 40*c*. The image display panel 40*c* is what is called a vertical electric field type. Alternatively, the image display panel 40*c* may be a horizontal electric field type that generates the electric field in a direction parallel to a display surface of the image display panel 40*c*.

A plurality of color filters 46 are arranged corresponding to the pixel electrodes 44. The pixel electrode 44, the counter electrode 45, and the color filter 46 constitute each sub-pixel 49. A light guide plate 47 is arranged on the surface of the counter substrate 42 opposite to the liquid crystal layer 43. For example, the light guide plate 47 is a transparent plate member made of an acrylic resin, a polycarbonate (PC) resin, a methyl methacrylate-styrene copolymer (MS resin), or the like. An upper surface 47A of the light guide plate 47 opposite to the counter substrate 42 is subjected to prism processing.

In the fourth embodiment, the light source unit 72 is an LED. As illustrated in FIG. 21, the light source unit 72 is arranged along a side surface 47B of the light guide plate 47. The light source unit 72 emits light to the image display panel 40*c* from the front surface of the image display panel 40*c* via the light guide plate 47. The light source unit 72 is switched ON/OFF through an operation by an image observer, or by an external light sensor and the like attached to the display device 10*c* to measure external light. The light source unit 72 emits light in an ON state, and does not emit light in an OFF state. For example, when the image observer feels that the image is dark, the image observer turns ON the light source unit 72, and causes the light source unit 72 to emit light to the image display panel 40*c* to brighten the image. When the external light sensor determines that the external light intensity is lower than a predetermined value, for example, the signal processing unit 20*c* turns ON the light source unit 72, and causes the light source unit 72 to emit light to the image display panel 40*c* to brighten the image. In the fourth embodiment, the signal processing unit 20*c* does not control the luminance of the light from the light source unit 72 corresponding to the expansion coefficient α. That is, the luminance of the light from the light source unit 72 is set irrespective of the expansion coefficient α described later. However, the luminance of the light from the light source unit 72 may be adjusted according to the operation by the image observer or a measurement result obtained by the external light sensor.

The following describes light reflection by the image display panel 40*c*. As illustrated in FIG. 21, external light LO1 is incident on the image display panel 40*c*. The external light LO1 is incident on the pixel electrode 44 through the light guide plate 47 and the image display panel 40*c*. The external light LO1 incident on the pixel electrode 44 is reflected by the pixel electrode 44, and is emitted to the outside as light LO2 through the image display panel 40*c* and the light guide plate 47. When the light source unit 72 is turned ON, light LI1 from the light source unit 72 is incident into the light guide plate 47 from the side surface 47B of the light guide plate 47. The light LI1 incident into the light guide plate 47 is scattered and reflected by the upper surface 47A of the light guide plate 47, and part of the light LI1 is incident into the image display panel 40*c* as light LI2 from the counter substrate 42 side of the image display panel 40*c* to be emitted onto the pixel electrode 44. The light LI2 emitted onto the pixel electrode 44 is reflected by the pixel electrode 44, and emitted to the outside as light LI3 through the image display panel 40*c* and the light guide plate 47. The other part of the light scattered by the upper surface 47A of the light guide plate 47 is reflected as light LI4, and repeatedly reflected in the light guide plate 47.

That is, the pixel electrode 44 reflects, to the outside, the external light LO1 or the light LI2 incident on the image display panel 40*c* from the front surface, which is a surface on an outer side (counter substrate 42 side), of the image display panel 40*c*. The light LO2 and the light LI3 reflected to the outside pass through the liquid crystal layer 43 and the color filter 46.

Accordingly, the display device 10 can display an image with the light LO2 and the light LI3 reflected to the outside. As described above, the display device 10*c* according to the fourth embodiment is a reflective display device including the light source unit 72 of a front light type and an edge light type. In the fourth embodiment, the display device 10*c* includes the light source unit 72 and the light guide plate 47. However, the display device 10*c* does not necessarily include the light source unit 72 and the light guide plate 47. In this case, the display device 10*c* can display the image with the light LO2 that is the reflected external light LO1.

The display device 10*c* is a reflective display device, and expands the input signal based on the expansion coefficient αb similarly to the display device 10*b* according to the third embodiment. Accordingly, the display device 10*c* can display the color having higher brightness than that of the color in the standard color space similarly to the display device 10*b* according to the third embodiment.

Application Example

Figure 22:
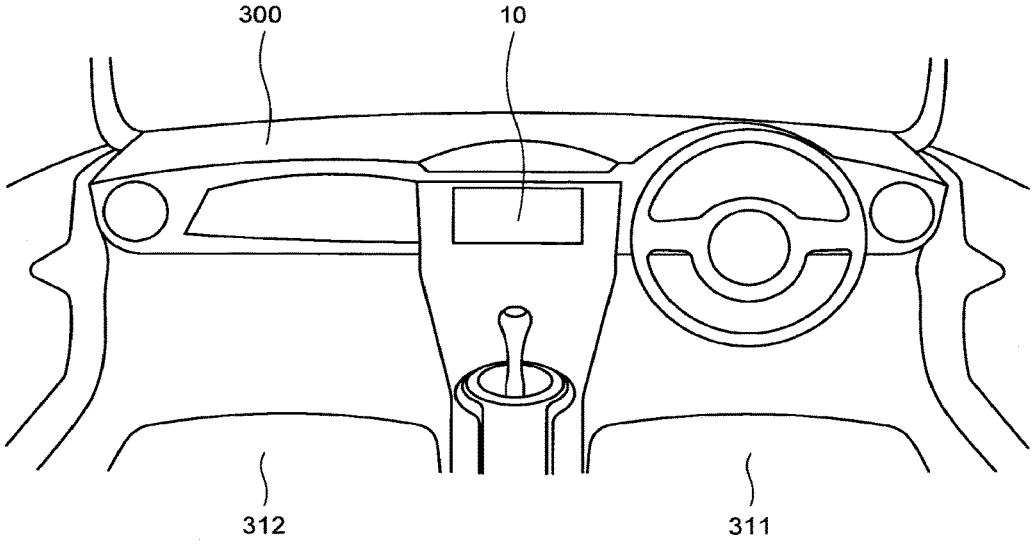
FIG. 22 is a diagram illustrating an example of an electronic apparatus to which the display device according to the first embodiment is applied.
Figure 23:
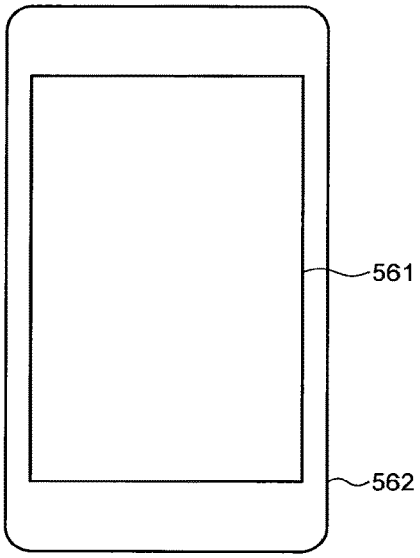
FIG. 23 is a diagram illustrating an example of the electronic apparatus to which the display device according to the first embodiment is applied.

With reference to FIGS. 22 and 23, the following describes application examples of the display device 10 described in the first embodiment. FIGS. 22 and 23 are diagrams each illustrating an example of an electronic apparatus to which the display device according to the first embodiment is applied. The display device 10 according to the first embodiment can be applied to electronic apparatuses in various fields such as a car navigation system illustrated in FIG. 22, a television apparatus, a digital camera, a notebook-type personal computer, a portable terminal device such as a cellular telephone illustrated in FIG. 23, and a video camera. In other words, the display device 10 according to the first embodiment can be applied to electronic apparatuses in various fields that display a video signal input from the outside or a video signal generated inside as an image or video. The electronic apparatus includes the control device 11 (refer to FIG. 1) that supplies the video signal to the display device and controls the operation of the display device. This application example can also be applied to the display devices according to the other embodiments and the modification described above in addition to the display device 10 according to the first embodiment.

The electronic apparatus illustrated in FIG. 22 is a car navigation device to which the display device 10 according to the first embodiment is applied. The display device 10 is mounted on a dashboard 300 inside an automobile. Specifically, the display device 10 is mounted on the dashboard 300 between a driver's seat 311 and a passenger seat 312. The display device 10 of the car navigation device is utilized for displaying navigation, displaying a music operation screen, reproducing and displaying a movie, or the like.

The electronic apparatus illustrated in FIG. 23 is a portable information terminal that operates as a portable computer, a multifunctional mobile phone, a mobile computer capable of making a voice call, or a mobile computer capable of performing communications to which the display device 10 according to the first embodiment is applied, and may be called a smartphone or a tablet terminal in some cases. The portable information terminal includes a display unit 561 on a surface of a housing 562, for example. The display unit 561 includes the display device 10 according to the first embodiment and has a touch detection (what is called a touch panel) function that can detect an external proximity object.

The embodiments of the present invention have been described above. However, the embodiments are not limited thereto. The components described above include a component that is easily conceivable by those skilled in the art, substantially the same component, and what is called an equivalent. The components described above can also be appropriately combined with each other. In addition, the components can be variously omitted, replaced, and modified without departing from the gist of the embodiments described above.

What is claimed is:

1. A display device comprising:

an image display panel including a plurality of pixels each including a first sub-pixel that displays a first color, a second sub-pixel that displays a second color, and a third sub-pixel that displays a third color; and a signal processing unit that generates an output signal from an input value of an input signal, and outputs the output signal to the image display panel, wherein in the third sub-pixel, a third sub-pixel maximum brightness as a displayable upper limit value of brightness of the third color is smaller than one of a first sub-pixel maximum brightness as a displayable upper limit value of brightness of the first color of the first sub-pixel and a second sub-pixel maximum brightness as a displayable upper limit value of brightness of the second color of the second sub-pixel, and is equal to or smaller than the other of the first sub-pixel maximum brightness and the second sub-pixel maximum brightness, and the signal processing unit stores an expanded color space extended with the first color, the second color, and the third color in a case in which the output signal for displaying the first color within a range of the first sub-pixel maximum brightness is output to the first sub-pixel, the output signal for displaying the second color within a range of the second sub-pixel maximum brightness is output to the second sub-pixel, and the output signal for displaying the third color within a range of the third sub-pixel maximum brightness is output to the third sub-pixel, acquires an expansion coefficient for expanding a color displayed by the image display panel to a color that is capable of being extended in the expanded color space, obtains an output signal of the first sub-pixel based on at least an input signal of the first sub-pixel and the expansion coefficient and outputs the output signal to the first sub-pixel, obtains an output signal of the second sub-pixel based on at least an input signal of the second sub-pixel and the expansion coefficient and outputs the output signal to the second sub-pixel, and obtains an output signal of the third sub-pixel based on at least an input signal of the third sub-pixel and the expansion coefficient and outputs the output signal to the third sub-pixel, wherein the expanded color space is a color space in which the upper limit value of the brightness in a case of displaying at least one of the first color and the second color is larger than the third sub-pixel maximum brightness, and being capable of extending a color the brightness of which is higher than brightness in a standard color space, which is extended with the first color, the second color, and the third color in a case of outputting the output signal for displaying a color in a case in which an upper limit value of displayable brightness is limited to the third sub-pixel maximum brightness to the first sub-pixel and the second sub-pixel, and outputting the output signal for displaying the color of the third sub-pixel maximum brightness to the third sub-pixel, wherein a displayable upper limit value of brightness of a color to be extended changes with a hue of the color to be extended in the expanded color space;

wherein, when the color to be extended has a hue between the first color and the third color in the expanded color space, the displayable upper limit value of the brightness at a maximum saturation is the third sub-pixel maximum brightness to the first sub-pixel maximum brightness;

wherein the displayable upper limit value of the brightness of the color to be extended gradually changes with the hue of the color to be extended in the expanded color space; and wherein, in the expanded color space, the displayable upper limit value of the brightness at the maximum saturation is the first sub-pixel maximum brightness when the color to be extended has a hue in a range from the hue of the first color to a first intermediate color having a predetermined hue between the first color and the third color, the displayable upper limit value of the brightness at the maximum saturation decreases in accordance with a change in the hue from the first intermediate color to a second intermediate color having a predetermined hue between the first intermediate color and the third color when the color to be extended has a hue in a range from the first intermediate color to the second intermediate color, and the displayable upper limit value of the brightness at the maximum saturation is the third sub-pixel maximum brightness when the color to be extended has a hue in a range from the second intermediate color to the third color.

2. The display device according to claim 1, wherein the first color is red, the second color is green, and the third color is blue.

3. The display device according to claim 2, wherein, in a case of displaying white having a maximum brightness on the image display panel, the signal processing unit outputs a specified output signal for displaying a color having a specified brightness smaller than the third sub-pixel maximum brightness to the first sub-pixel, the second sub-pixel, and the third sub-pixel to display white with the first color, the second color, and the third color, and in a case of displaying a color other than white, the signal processing unit outputs an output signal having a signal value larger than the specified output signal to enable the first sub-pixel, the second sub-pixel, and the third sub-pixel to display a color having brightness higher than the specified brightness.

4. The display device according to claim 1, wherein the image display panel further includes a fourth sub-pixel that displays a fourth color, the expanded color space is extended also based on the fourth color in a case in which the output signal for displaying the fourth color in a range of fourth sub-pixel maximum brightness as the displayable upper limit value of the brightness of the fourth color is output to the fourth sub-pixel, and the signal processing unit obtains an output signal of the fourth sub-pixel based on the input signal of the first sub-pixel, the input signal of the second sub-pixel, the input signal of the third sub-pixel, and the expansion coefficient.

5. The display device according to claim 1, wherein the image display panel is a self-luminous type image display panel in which the first sub-pixel displays the first color depending on a lighting quantity of a self-luminous body, the second sub-pixel displays the second color depending on the lighting quantity of the self-luminous body, and the third sub-pixel displays the third color depending on the lighting quantity of the self-luminous body.

6. The display device according to claim 1, wherein the image display panel is a liquid crystal display panel, and the display device further comprises a light source unit that is arranged on a back surface side of the image display panel opposite to a display surface on which an image is displayed, and emits light to the image display panel based on a light source control signal from the signal processing unit.

7. The display device according to claim 1, wherein the image display panel is a liquid crystal display panel, and each of the first sub-pixel, the second sub-pixel, and the third sub-pixel includes a reflection unit that reflects light incident from a front surface of the image display panel, and displays an image with light reflected by the reflection unit.

8. An electronic apparatus comprising:

the display device according to claim 1; and a control device that controls the display device.

* * * * *